US011927018B1

(12) United States Patent
Russell

(10) Patent No.: US 11,927,018 B1
(45) Date of Patent: Mar. 12, 2024

(54) SHINGLE TESTING TOOL AND METHODS OF MAKING AND USING THE SAME

(71) Applicant: Jon Russell, Kennesaw, GA (US)

(72) Inventor: Jon Russell, Kennesaw, GA (US)

(73) Assignee: Jon Russell, Kennesaw, GA (US)

( * ) Notice: Subject to any disclaimer, the term of this patent is extended or adjusted under 35 U.S.C. 154(b) by 472 days.

(21) Appl. No.: 17/393,296

(22) Filed: Aug. 3, 2021

(51) Int. Cl.
*E04D 15/02* (2006.01)

(52) U.S. Cl.
CPC ..... *E04D 15/02* (2013.01)

(58) Field of Classification Search
CPC ..... E04D 15/02; E04D 15/025
USPC ..... 33/648
See application file for complete search history.

(56) References Cited

U.S. PATENT DOCUMENTS

| | | | | | |
|---|---|---|---|---|---|
| 718,101 | A | | 1/1903 | Decker | |
| 1,783,260 | A | * | 12/1930 | Reed | E04F 21/1855 33/646 |
| 2,470,183 | A | * | 5/1949 | Peters | E04D 15/04 33/649 |
| 4,009,743 | A | | 3/1977 | Ackerman | |
| 5,575,132 | A | | 11/1996 | Garsjo | |
| 5,692,311 | A | * | 12/1997 | Paquin | E04D 15/04 33/647 |
| 5,735,057 | A | * | 4/1998 | Morford | E04D 15/025 7/122 |
| 6,378,223 | B1 | * | 4/2002 | Korich | G01B 3/02 33/649 |
| 7,275,333 | B1 | * | 10/2007 | Neuroth | E04F 21/1855 33/646 |
| 9,631,383 | B1 | | 4/2017 | Mathieson | |
| 10,329,771 | B2 | * | 6/2019 | Prevatt | E04D 1/29 |
| 11,479,980 | B1 | * | 10/2022 | Gregory | E04F 13/0803 |
| 2004/0010929 | A1 | * | 1/2004 | Whitford | E04D 15/025 33/649 |
| 2017/0167141 | A1 | | 6/2017 | Mathieson | |

FOREIGN PATENT DOCUMENTS

| | | |
|---|---|---|
| EP | 0699810 | 3/1996 |

OTHER PUBLICATIONS

"PacTool RS501 Roof Snake Tool—Shingle Pry Bar", Unknown Publication Date but believed to be prior to filing of present application; Viewed online Apr. 20, 2022 at https://www.amazon.com/PacTool-International-RS501-Shingle-Installer/dp/B00005A1K9?ref_=ast_sto_dp&th=1&psc=1.

"ShingleShock Roof Shingle Installer Roofing Tool, Steel Black, Rubber Grip, Magnet", Unknown production date but believed to be prior to filing of present application; Viewed online Apr. 20, 2022 at https://www.amazon.com/ShingleShock-Shingle-Installer-Roofing-Rubber/dp/B08C22PZFK/ref=sr_1_1?keywords=ShingleShock&qid=1651776665&sr=8-1.

(Continued)

*Primary Examiner* — George B Bennett
(74) *Attorney, Agent, or Firm* — Philip H. Burrus, IV

(57) ABSTRACT

A shingle testing tool includes a base member and an inclined shingle support plate. The inclined shingle support plate intersects a first end of the base member at a leading convex edge. The inclined shingle support plate defines one or more shingle structural reliability measurement graduations. The shingle testing tool can be used to determine if a damaged shingle can be replaced without damage to another shingle overlapping the damage shingle.

20 Claims, 22 Drawing Sheets

(56) References Cited

OTHER PUBLICATIONS

"4/09 Shingle Gauge", HAAG Education—Books & Tools; Unknown Publication Date but prior to filing or present application; Viewed online at https://haageducation.com/books-tools/409-shingle-gauge/1/ on Apr. 30, 2021.

"Xactimate—Claims Estimating Software", Verisk; Roofing System Claims Estimator; Unknown production date but believed to be prior to filing of present application; Viewed online at https://www.xactware.com/en-us/solutions/claims-estimating/xactimate/professional/.

* cited by examiner

SHINGLE TESTING TOOL AND METHODS OF MAKING AND USING THE SAME

BACKGROUND

Technical Field

This disclosure relates generally to mechanical tools, and more particularly to mechanical tools for testing roofing shingles.

Background Art

A hailstorm can be a devastating event. From damaging grape vines during harvest to denting new cars during delivery, when hail falls from the sky it rarely bodes well for objects within the path of its journey toward earth. This general truth even applies to industrial materials designed to withstand weather. Illustrating by example, asphalt shingles used to roof houses, buildings, and other structures are subject to hail damage as well. Depending upon the size, density, velocity, or other characteristics of the hailstones, the ability of an asphalt-shingled roof to withstand rain, storms, and wind can be severely compromised by a single storm. For this reason, many insurance carriers offer coverage that will repair or replace portions or all of an asphalt-shingled roof that is sufficiently damaged by hail.

Consumers and laymen are seldom well equipped to determine whether a roof damaged by hail, wind, or other storm phenomena requires only partial repairs or, instead, a complete roof replacement. Attempting to err on the side of caution, they may prematurely file an insurance claim demanding that their entire roof be replaced after a heavy storm. Many professionals lack the requisite training to determine whether a portion of a roof can be repaired without creating new damage to other portions of the roof as well. They may therefore needlessly recommend replacing the entire roof to avoid future insurance claims. It would therefore be advantageous to have an improved device for testing asphalt shingles.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
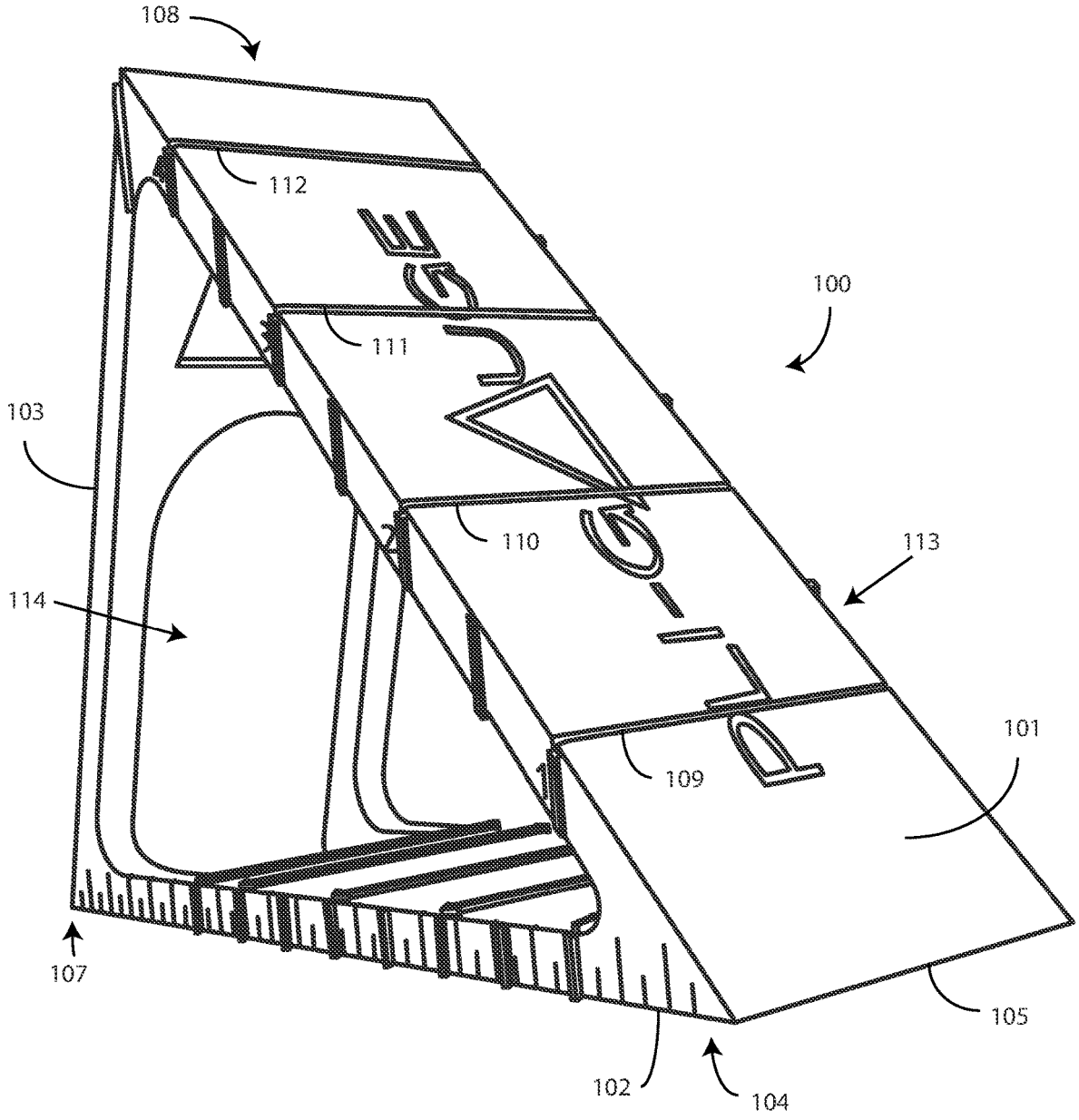
FIG. 1 illustrates a first perspective view of one explanatory shingle testing tool in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

As used herein, the terms "substantially," "essentially," "approximately," "about," or any other version thereof, are defined as being close to as understood by one of ordinary skill in the art, and in one non-limiting embodiment the term is defined to be within ten percent, in another embodiment within five percent, in another embodiment within one percent and in another embodiment within one-half percent. The term "coupled" as used herein is defined as connected, although not necessarily directly. Also, reference designators shown herein in parenthesis indicate components shown in a figure other than the one in discussion. For example, talking about a device (10) while discussing figure A would refer to an element, 10, shown in figure other than figure A.

Alternate implementations are included, and it will be clear that the various method and usage steps set forth below may be executed out of order from that shown or discussed, including substantially concurrently or in reverse order, depending on the functionality involved. Accordingly, the apparatus components and method steps described below have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, it is expected that one of ordinary skill, notwithstanding possibly significant effort and many design choices motivated by, for example, available time, current technology, and economic considerations, when guided by the concepts and principles disclosed herein will be readily capable of generating shingle tools in accordance with embodiments of the disclosure and variants obvious to those of ordinary skill in the art having the benefit of this disclosure with minimal experimentation.

Asphalt shingles are frequently used to cover the roofs of houses, buildings, outbuildings, sheds, and other structures. While quite durable, asphalt shingles are not impervious to weather. Asphalt shingles can sustain damage in various weather-related events including hail damage, wind damage, damage from debris, and so forth.

When damage occurs, it can be difficult to determine whether the roof can be repaired or whether it needs to be entirely replaced. Consequently, some people needlessly replace their entire roof despite the fact that damaged shingles can be repaired without affecting the shingles that still retain substantial service life.

Embodiments of the disclosure contemplate that it can be difficult for even trained personnel to determine whether a roof can be partially repaired. This is particularly true when potentially damaged shingles are centrally situated along a rooftop. Current testing methods involve an inspector scaling a roof to visually ascertain, using their hands to break shingle seals and manipulate shingles, whether shingles surrounding damaged shingles can be sufficiently manipulated such that the damage shingle can be repaired without deleteriously affecting the manipulated shingle. The difficulty of this visual inspection process is compounded by the fact that shingled roofs are typically constructed with their asphalt shingles arranged in an overlapping pattern, which requires "good" shingles overlapping "damaged" shingles to be lifted and manipulated if the damaged shingles thereunder are to be replaced. In addition to being time consuming and expensive, current visual inspection techniques lack objective standards and procedures and can even cause damage to surrounding shingles.

Due to this lack of a standard procedure, it is often the case that disagreement arises between responsible parties regarding whether a particular shingle that may have been damaged by a storm can physically be replaced without imparting damage to the surrounding shingles. Factors affecting the surrounding, undamaged shingles such as age, condition, and overall deterioration combine to determine whether the surrounding, undamaged shingles can be sufficiently manipulated to allow the underlying damaged shingle to be repaired. When assessing these factors, like minds can reach differing conclusions due to the fact that there is no single standard for determining whether a shingle can be sufficiently manipulated to allow for underlying shingles to be replaced while still remaining reliable after manipulation. Prior art testing methods are wholly inconsistent, and the divergent methods of testing can result in many unnecessary expenditures for property owners and insurance carriers.

In the business of roofing inspection, once damage has been discovered on one or more shingles, a "brittle test" is performed by hand. Usually after the inspection is complete, and at a later date, an insured party, the insurance carrier, and the insured party's contractor have discussions about the results of the brittle test, as well as how repairs may or may not be able to be made without damaging adjacent shingles. Frequently, these discussions occur regardless of what the results of the brittle test may be. To make a proper repair, shingles adjacent to the damaged shingles will need to be lifted.

At this point, the insurance carrier may request that the insured party's contractor make an attempt to repair at least some of the shingles, with the results of the repair attempt being photographed. It is frequently the case that the repair attempt will fail. This is not necessarily due to the intent or competence of the insured party's contractor, but rather due to the fact that the shingle is no longer sufficiently pliable.

Compounding matters, it is frequently the case that attempts to repair asphalt shingles are performed improperly. This can occur due to a variety of reasons, examples of which can include improper fastening practices such as "high nailing" where an undamaged shingle is lifted to an unnecessary elevation to allow a hammer to swing and drive a fastener into the shingle being repaired. This high nailing practice can result in the fastener being as much as one to two inches higher than the manufacturer recommendation. This unnecessary high lift can cause the bend in the lifted shingle to exceed ninety degrees from the roof deck. Sometimes the bend even extends to an angle of between 120 and 180 degrees from the roof deck. Such bending creates creasing and tearing in the undamaged shingle, with such damage occurring even in new shingles that are less than five years old. Where such practices occur, almost every repair attempt will fail. Sometimes, this can even be the intent of the repairer, as more profit can be obtained from roof replacement than from roof repair.

Advantageously, embodiments of the disclosure provide visual proof that a shingle can—or cannot—be repaired without damage to surrounding shingles that are to be manipulated during the repair process. Embodiments of the disclosure provide a shingle testing tool that can quickly and precisely test the pliability and overall "repairability" of asphalt shingles. The use of embodiments of the disclosure advantageously prevents the nefarious actor problem described in the previous paragraph by combatting deceptive reporting of results from improper or intentional repair techniques.

Accordingly, embodiments of the disclosure provide financial benefits to both the insured and the contractor. This is in addition to the fact that the insured party may well avoid the unsightly situation associated with mismatched patches of replaced shingles. The unsightliness of mismatched shingles can be exacerbated when the shingles in-place are aged, deteriorated, or covered in black algae. Moreover, the unsightliness will result in a high contrast between the new and old shingles. This is true even if the colors and patterns are the same or similar. Advantageously, embodiments of the disclosure establish a base line of potential repair with measurable evidence of lift versus clearance for fastener placement and hammer swing. Discussions on mismatching, installer competence, quantities of damaged shingles versus undamaged shingles, and so forth, can be had after tests using embodiments of the disclosure have been completed and a measurable base line has been set.

In order to repair a damaged shingle, surrounding "undamaged" shingles need to be manipulated to enable a proper repair. This manipulation includes:

(1) breaking the bond between shingles created by the sealant applied to the shingle at the factory that thermally activates during installation to bond adjacent shingles;
(2) lifting the undamaged shingle(s) high enough for reasonable access the to the fastener locations (frequently a nail head) of the damaged shingle situated beneath the undamaged shingle(s);
(3) removal of the damaged shingle and replacement with a new shingle; and
(4) reinstalling new fasteners in the new shingle and/or any new fasteners for fasteners that were removed from the shingle above.

Figure 29:
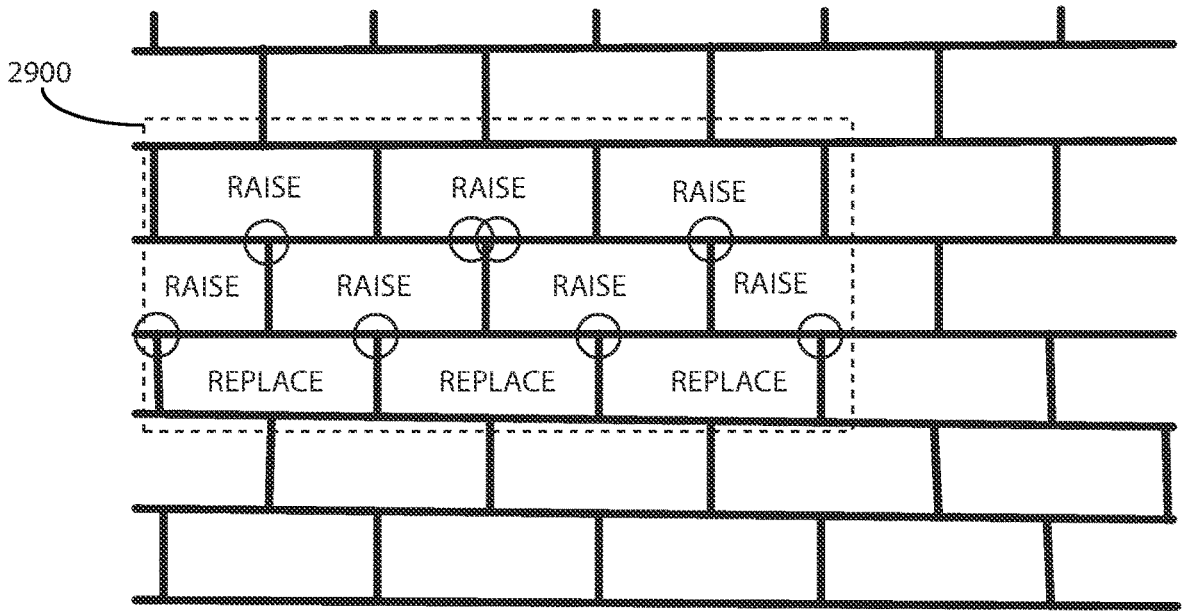
FIG. 29 illustrates a single repair area.

Compounding matters, each of these steps must be accomplished without causing damage by creasing or breaking the undamaged, manipulated adjacent shingles. Illustrating by example, if a new shingle is installed properly to repair a damaged one, a total of eight nails should have to be removed and two shingles will need to be manipulated and/or lifted, re-secured, and resealed. This is shown in FIG. 29, where a shingle repair area 2900 includes eight circles indicating the eight nails that would need to be removed to replace three lower shingles. This requires raising at least seven other shingles as shown in FIG. 29. It should ne noted that these eight nails become twelve when the pitch of the roof exceeds sixty degrees or a 21-12 ratio pitch. The number of nails may increase as well when the roof is located in a geographic zone where excessive wind loads force a 6-nail pattern for shingles.

Advantageously, embodiments of the disclosure provide a shingle testing tool and corresponding methods that provide a simple, quick, standardized, and repeatable method for inspecting asphalt shingles to determine whether they can be sufficiently manipulated so as to allow shingles situated therebeneath to be replaced without deleteriously affecting or compromising the structural reliability of the manipulated shingle. Embodiments of the disclosure contemplate that a common misconception among shingle inspectors is how high an undamaged shingle must be lifted in order to perform a proper repair to a damaged shingle therebeneath. Advantageously, embodiments of the disclosure provide a shingle testing tool that eliminates the inconsistencies between shingle testing performance and shingle testing results. Moreover, embodiments of the disclosure offer a shingle testing tool that provides measurements of how high a shingle can be lifted to clear the nail line for reasonably and properly re-securing a new shingle thereunder with new fasteners.

In one or more embodiments, a shingle testing tool comprises a base member and an inclined shingle support plate. In one or more embodiments, the base member and the inclined shingle support plate intersect at a first end of the base member to define a leading convex edge of the single testing tool.

In one or more embodiments, the inclined shingle support plate defines one or more shingle structural reliability measurement graduations. Illustrating by example, in an explanatory embodiment the inclined shingle support tool defines a plurality of measurement graduations that indicate multiples of a predefined measurement unit indicating the elevation of a shingle edge from a base member as the shingle edge translates up the inclined shingle support plate from the leading convex edge. For instance, in one embodiment the plurality of measurement graduations consists of four measurement graduations with each graduation indicating a multiple of a predefined measurement unit of one inch of elevation experienced by an edge of the shingle as the shingle slides up the inclined shingle support plate from the leading convex edge. Other numbers of measurement graduations and predefined measurement units will be obvious to those of ordinary skill in the art having the benefit of this disclosure.

Embodiments of the disclosure contemplate that in the field there are many variations of shingle dimensions, shingle exposure configurations, recommended fastener heights (from the shingle butt), and required amounts of lift needed to expose the nail line of the shingle situated beneath the shingle being tested. Advantageously, illustrative embodiments of the disclosure set forth in the accompanying figures accommodate, and can be used with, at least fifty different shingle models of three-tab and architectural/laminate shingles manufactured by the top nine shingle producers in the United States. Illustrating by example, one illustrative shingle testing tool configured in accordance with one or more embodiments of the disclosure can be used with shingles having widths of between twelve and fourteen inches, exposure configurations of between five and six inches, and nail height recommendations (from the butt of the shingle) of between 5.25 inches and 6.375 inches.

Shingle testing tools configured in accordance with embodiments of the disclosure provide the inspector, as well as others reviewing the inspector's work, with definitive and minimum height requirements of shingle lift for proper nail placement. Additionally, embodiments of the disclosure allow an inspector to determine the effects that usage of the shingle testing tool on a tested shingle have had, if any. Usage of embodiments of the disclosure allows responsible parties to make more educated decisions regarding whether a roof can be repaired or if replacement is instead required.

In one or more embodiments, the shingle testing tool further comprises a rear support member intersecting a second end of the base member at a trailing convex edge. In one or more embodiments, the rear support member extends from the second end of the base member to a distal end of the inclined shingle support plate.

One or more side panels can then span one or both of a first side and/or a second side of the base member, the inclined shingle support plate, and the rear support member. For example, a first side panel can span a first side of each of the base member, the inclined shingle support plate, and the rear support member. Similarly, a second side panel can span the second side of each of the base member, the inclined shingle support plate, and the rear support member.

In one or more embodiments, each of the first side panel and the second side panel define an aperture. Such an aperture can make the shingle testing tool easier to hold and use. In an explanatory embodiment, the aperture defined by the first side panel and second side panel is substantially triangular in shape. For instance, the aperture can be a triangle with rounded corners, although other shapes for the aperture—where included—will be obvious to those of ordinary skill in the art having the benefit of this disclosure. In one or more embodiments, the aperture has a central axis that is oriented substantially orthogonally with other axes passing normally through the base member, the inclined shingle support plate, and the rear support member, respectively.

In one or more embodiments, to make measurements easier to see from the side, one or both of the first side panel and second side panel can include one or more measurement indicators. In one or more embodiments, each of the first side panel and the second side panel include two sets of measurement indicators.

Illustrating by example, in one or more embodiments a first portion of the first side panel and/or the second side panel can include one or more first portion measurement indicators extending distally from the one or more shingle structural reliability measurement graduations positioned in the inclined shingle support plate. Similarly, a second portion of the first side panel and/or second side panel can include a plurality of second section measurement indicators with at least some of those second section measurement indicators being co-linear with the one or more first portion measurement indicators on a one-to-one basis.

A major surface of the base member facing the inclined shingle support plate can also include a plurality of base member measurement indicators each arranged in a co-planar relationship with a corresponding first portion measurement indicator and a corresponding shingle structural reliability measurement graduation as well. These various measurement indicators can be used to determine how far up the inclined shingle support plate a shingle will slide, and therefore the elevation of the edge of the shingle, when the shingle testing tool is positioned between a first shingle and a second shingle of a roof with the leading convex edge inserted until the shingle testing tool stops.

In addition to measuring how far up the inclined shingle support plate a shingle will slide, and therefore the elevation of the shingle edge, when the shingle testing tool is positioned between a first shingle and a second shingle of a roof, in one or more embodiments the second portion of the first side panel and/or the second side panel includes additional measurement indicators defining a ruler extending along the second portion of the first side panel and/or second side panel from the first end of the base member to the second end of a base member. As will be described in more detail below with reference to FIGS. 9 and 10, in one or more embodiments a method of using the shingle testing tool includes determining whether a nail passing through the shingle abutting the base member when the shingle testing tool is placed between a first shingle and a second shingle is exposed beyond the second end of the base member. Where it is not, the measurement indicators defining the ruler allow an inspector to quickly determine how far above the roof deck the edge of the shingle elevates as it travels up the inclined shingle support plate from the leading convex edge the nail is positioned when the shingle testing tool is maximally inserted between the first shingle and the second shingle.

In one or more embodiments, a method of using the shingle testing tool comprises inserting the convex leading edge of the shingle testing tool between a first shingle and a second shingle when those shingles are attached to a roof in an overlapping pattern. The method then includes translating the convex edge of the shingle testing tool toward a nail passing through the first shingle, thereby causing the first shingle to clime the inclined shingle support plate.

In one or more embodiments, once the shingle testing tool can no longer be translated toward the nail, the method includes measuring, using the one or more shingle structural reliability measurement graduations, an elevation of the edge of the shingle by measuring a corresponding amount the first shingle has climbed the inclined shingle support plate. Experimental testing has shown that translation of the shingle across the entirety of the inclined shingle support plate provides sufficient lift for the shingle below to be fully replaced. Moreover, the shingle sliding up the inclined shingle support plate can later be physically inspected for cracking, tearing, or other damage to determine whether the lifted shingle will still have sufficient structural reliability remaining after the shingle positioned beneath this lifted shingle has been replaced.

The shingle testing tool can include other features as well. Illustrating by example, in one or more embodiments the rear support member defines a carabiner attachment port that allows the shingle testing tool to be conveniently carried around the neck or from the belt when not in use. In one or more embodiments, the inclined shingle support plate comprises decorative indicia along with the shingle structural reliability measurement graduations. Other features suitable for inclusion with the shingle testing tool will be described below. Still others will be obvious to those of ordinary skill in the art having the benefit of this disclosure.

Embodiments of the disclosure provide a shingle testing tool that is very simple to use. At the same time, the shingle testing tool provides verifiable evidence of the conditions of roof shingles and their ability to be manipulated when damaged shingles are replaced. Unlike prior art, subjective procedures performed with fingers, embodiments of the disclosure provide consistent measurements and methods that are repeatable for any inspector. Other advantages associated with the shingle testing tool and its method of use will be described below. Still others will be obvious to those of ordinary skill in the art having the benefit of this disclosure.

Figure 2:
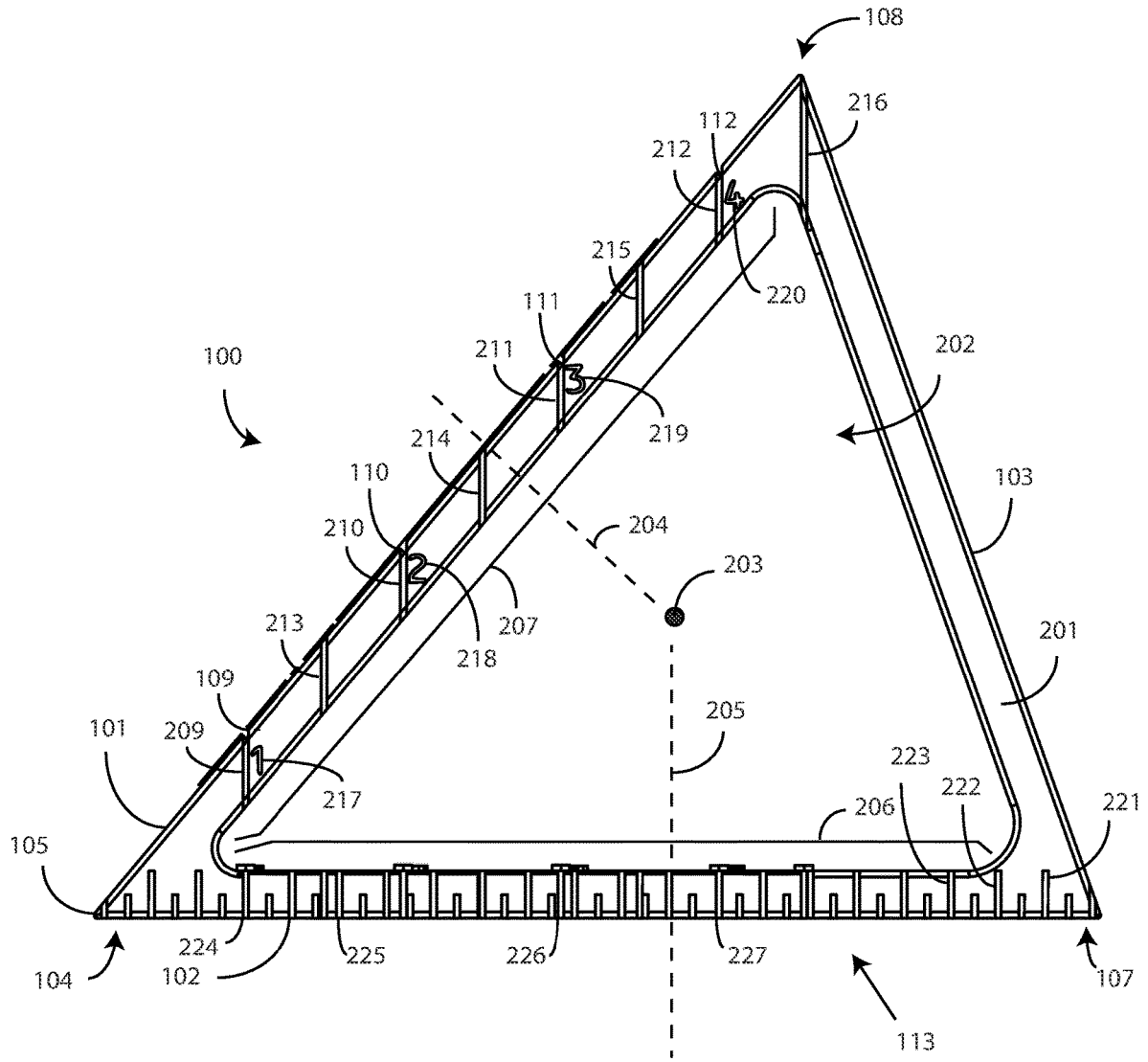
FIG. 2 illustrates a right, side elevation view of one explanatory shingle testing tool in accordance with one or more embodiments of the disclosure.
Figure 3:
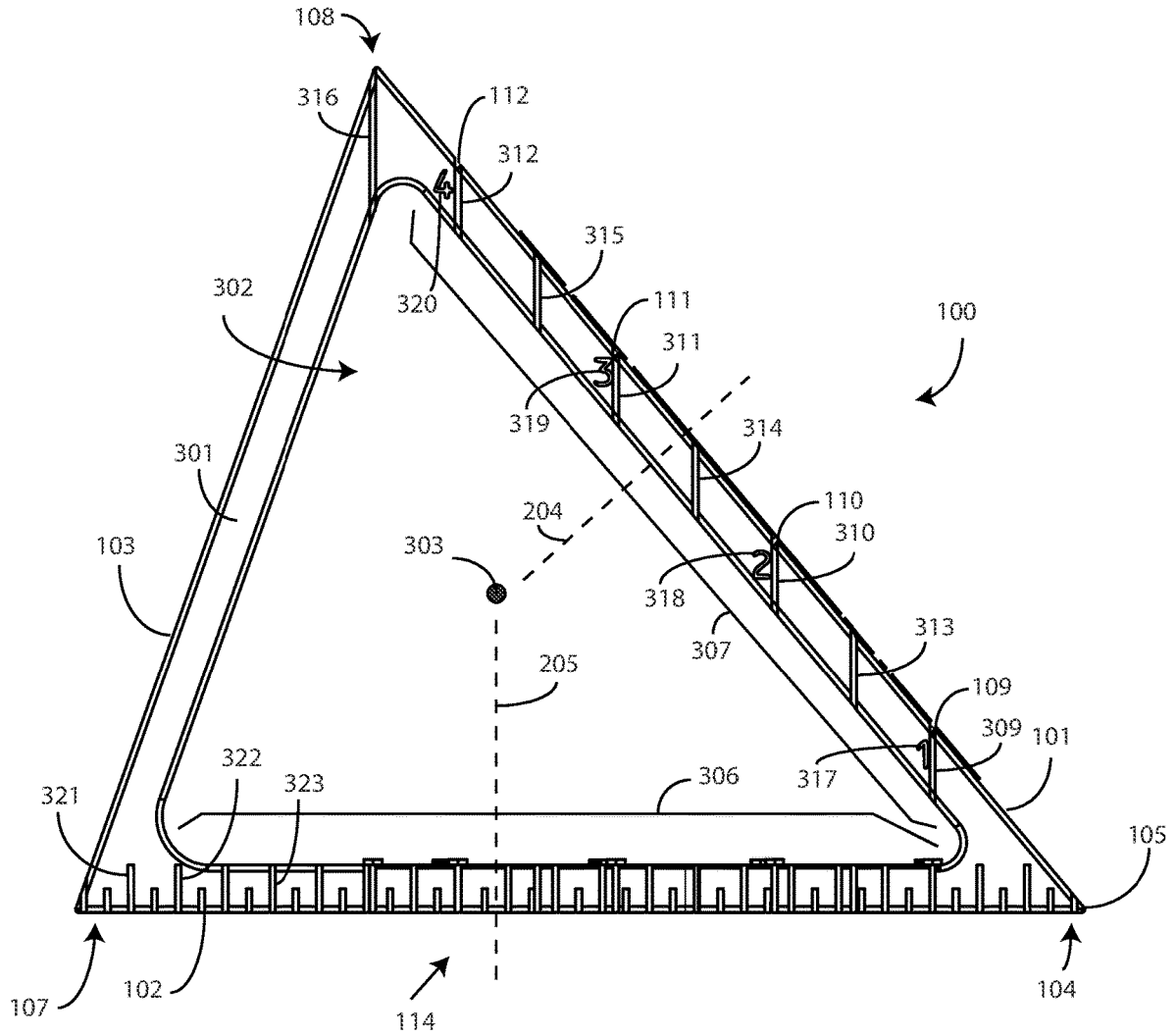
FIG. 3 illustrates a left, side elevation view of one explanatory shingle testing tool in accordance with one or more embodiments of the disclosure.
Figure 4:
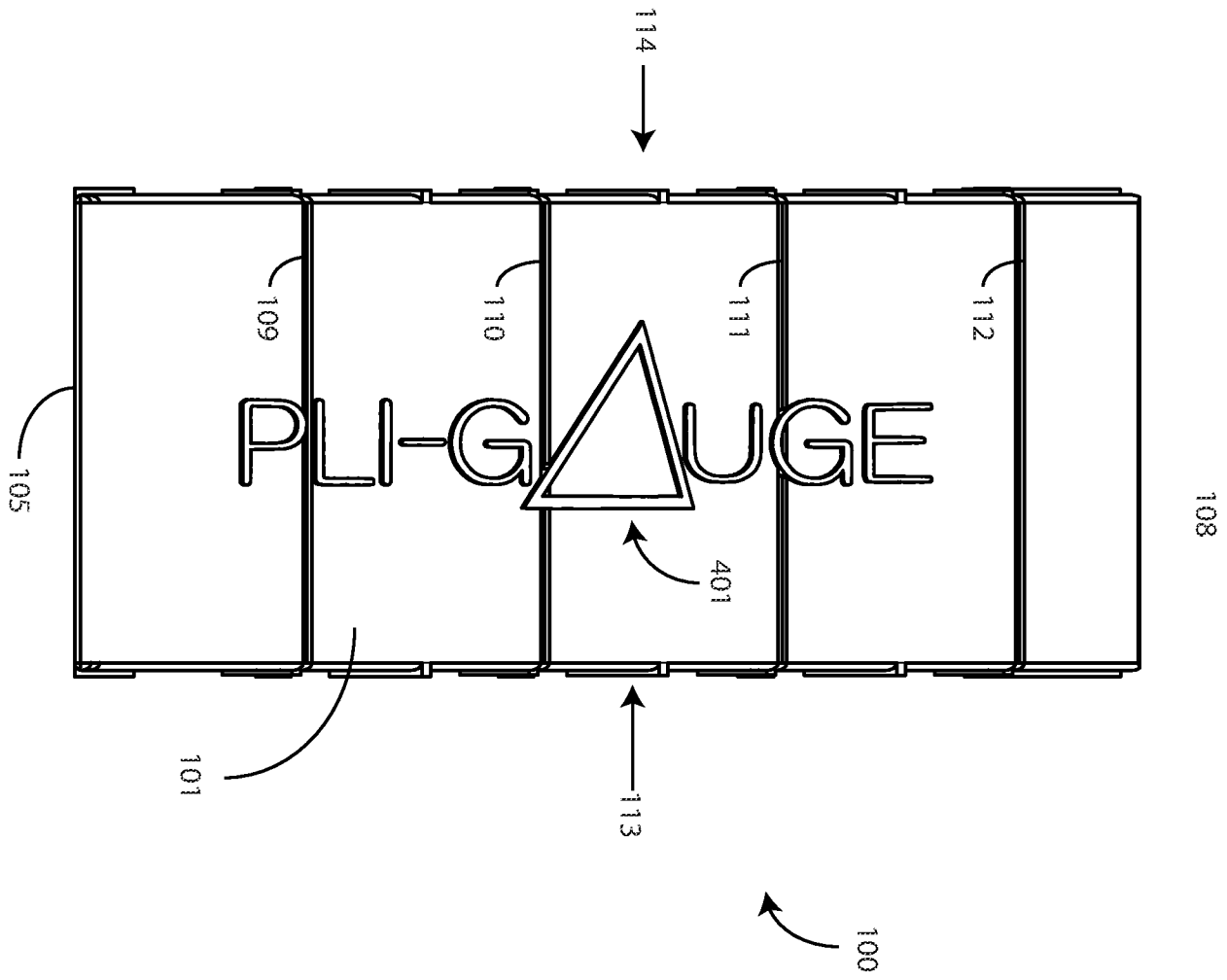
FIG. 4 illustrates a front elevation view of one explanatory shingle testing tool in accordance with one or more embodiments of the disclosure.
Figure 5:
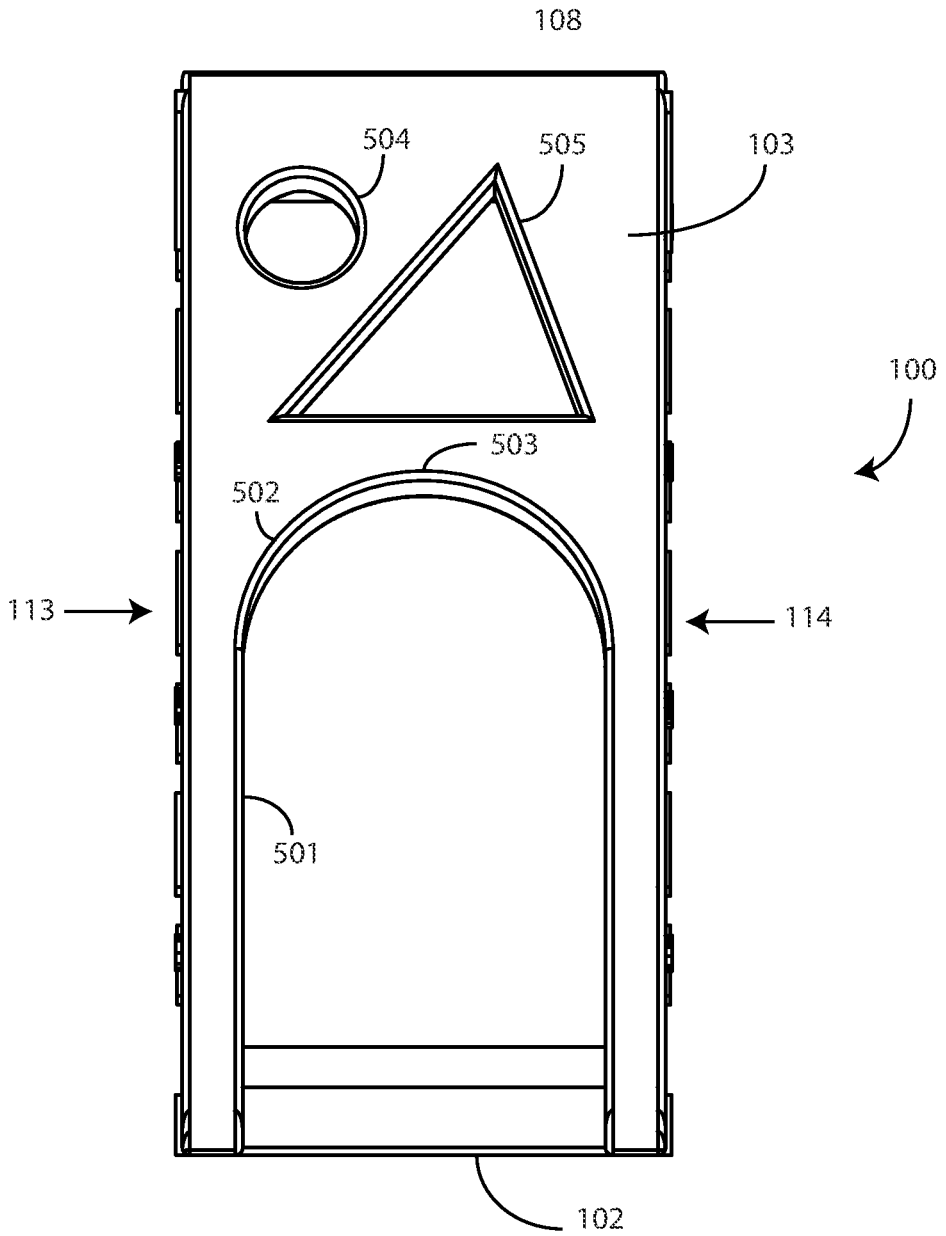
FIG. 5 illustrates a rear elevation view of one explanatory shingle testing tool in accordance with one or more embodiments of the disclosure.
Figure 6:
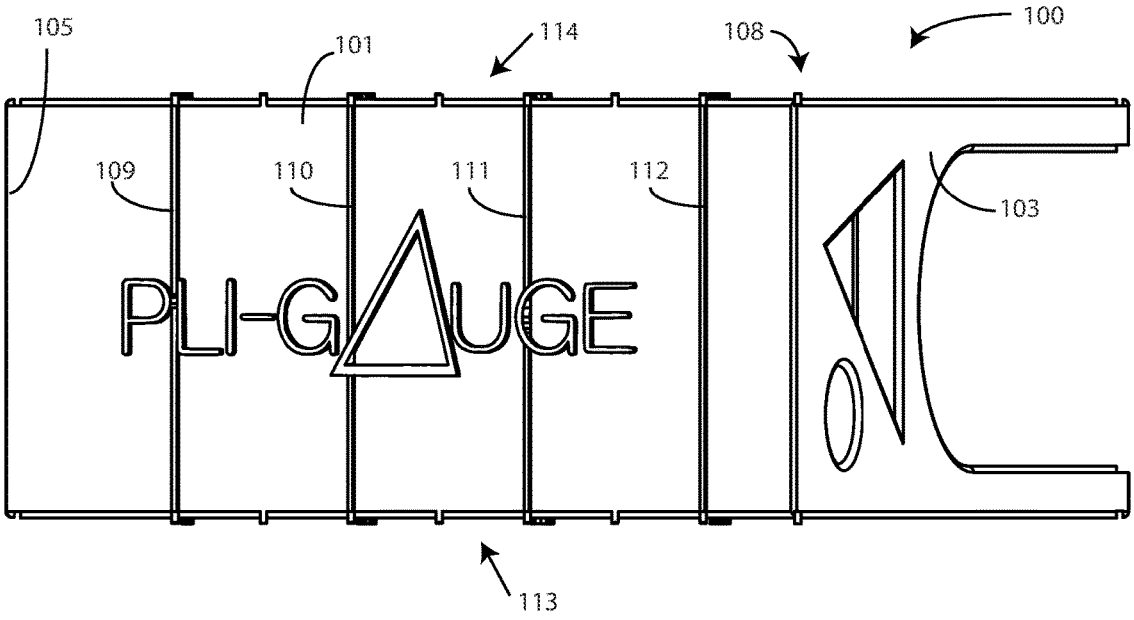
FIG. 6 illustrates a top plan view of one explanatory shingle testing tool in accordance with one or more embodiments of the disclosure.
Figure 7:
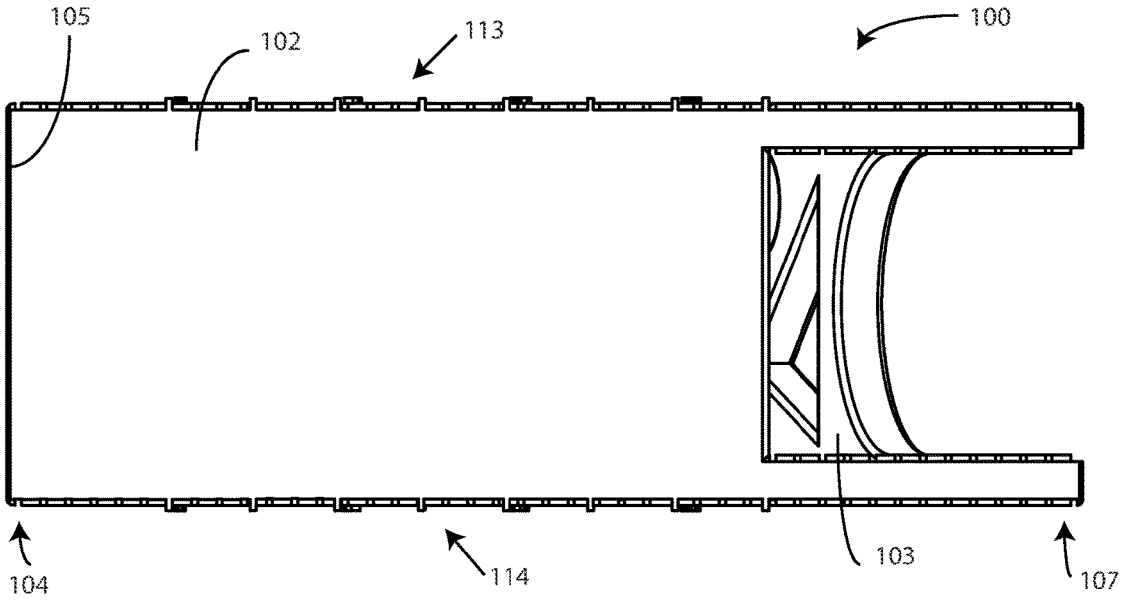
FIG. 7 illustrates a bottom plan view of one explanatory shingle testing tool in accordance with one or more embodiments of the disclosure.
Figure 8:
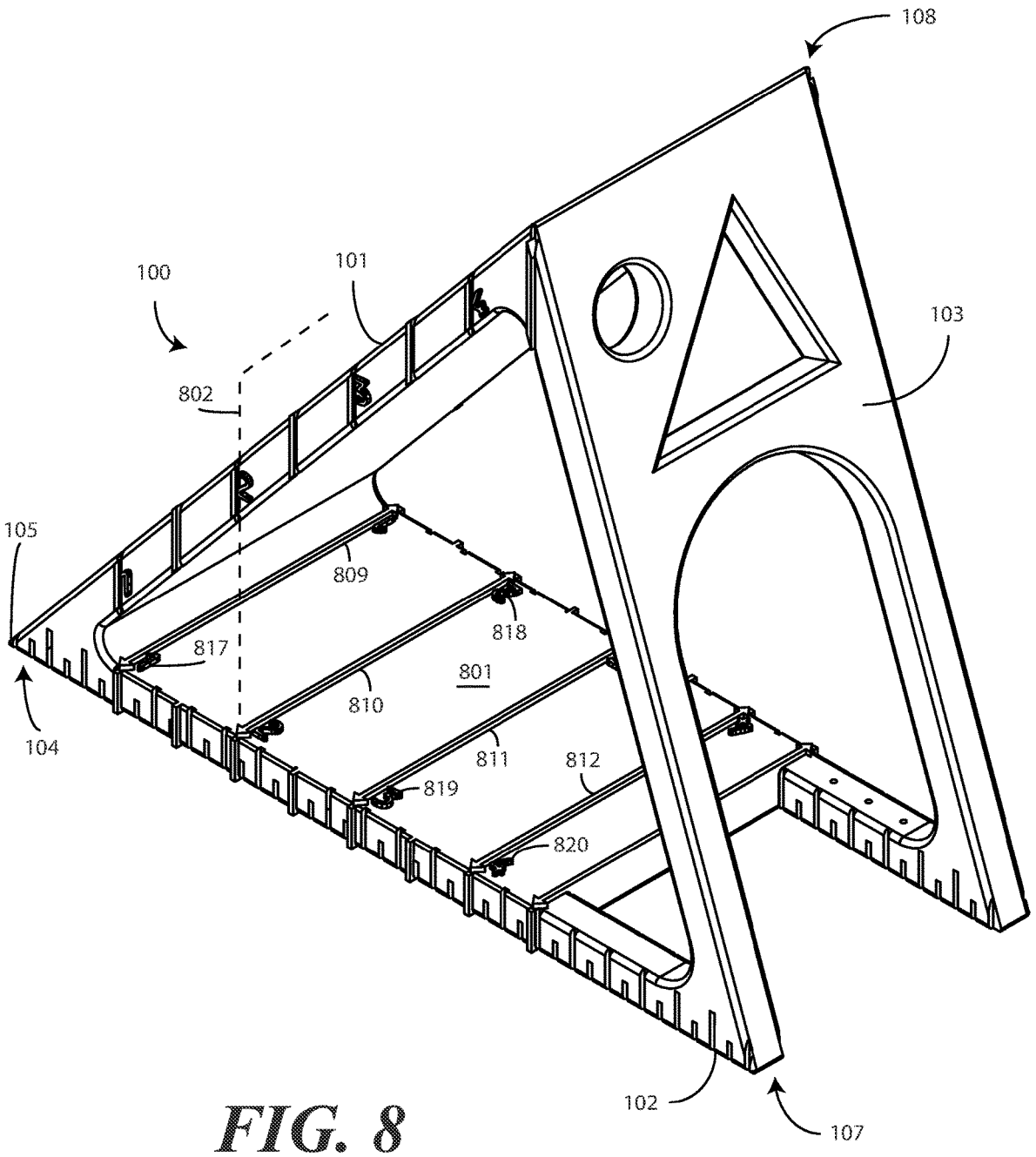
FIG. 8 illustrates a second perspective view of one explanatory shingle testing tool in accordance with one or more embodiments of the disclosure.

Turning now to FIGS. 1-8, illustrated therein is one explanatory shingle testing tool 100 configured in accordance with one or more embodiments of the disclosure. FIGS. 1 and 8 each illustrate different perspective views of the shingle testing tool 100, while FIGS. 2 and 3 illustrate right and left side elevation views of the shingle testing tool 100, respectively. FIG. 4 illustrates a front elevation view of the shingle testing tool 100, while FIG. 5 illustrates a rear elevation view of the shingle testing tool 100. FIG. 6 illustrates a top plan view of the shingle testing tool 100, while FIG. 7 illustrates a bottom plan view of the shingle testing tool 100.

In one or more embodiments, the shingle testing tool 100 comprises an inclined shingle support plate 101, a base member 102, and a rear support member 103. In one or more embodiments, the inclined shingle support plate 101 and the base member 102 intersect at a first end 104 of the base member 102 to define a leading convex edge 105. The rear support member 103 then intersects a second end 107 of the base member 102 to define a trailing convex edge 105. In one or more embodiments, the rear support member 103 extends to a distal end 108 of the inclined shingle support plate 101.

In one embodiment, the shingle testing tool 100 is configured as a single, unitary element. Said differently, in one embodiment the inclined shingle support plate 101, the base member 102, and the rear support member 103 are manufactured as a single, integral unit.

The shingle testing tool 100 can be manufactured in a variety of ways. In one embodiment, the shingle testing tool 100 is manufactured from a thermoplastic material by way of an injection molding process. The shingle testing tool 100 can also be manufactured from a sheet of thermoplastic material in a vacuum molding process. As will be described below with reference to FIGS. 17-18, in other embodiments the shingle testing tool 100 can be manufactured from a blank of metal or other rigid material by bending or otherwise forming the various components of the shingle testing tool 100. Other methods for manufacturing the shingle testing tool 100 will be obvious to those of ordinary skill in the art having the benefit of this disclosure.

In one or more embodiments, portions of the shingle testing tool 100 are configured to be flexible or pliant to "grip" portions of shingles between which the shingle testing tool 100 is placed. Some materials suitable for such constructions include styrene, resins, rubber, or other pliant compounds. In other embodiments, the components of the shingle testing tool 100 are manufactured from rigid materials. The use of rigid materials can be preferable as it can reduce friction occurring when, for instance, a shingle slides up the inclined shingle support plate. Illustrating by example, the shingle testing tool 100 can be manufactured from nylon, styrene, acrylonitrile butadiene styrene (ABS), polycarbonate, or polycarbonate-ABS, poly(methyl methacrylate (PMMA), polyvinyl chloride (PVC), or other polyamide-based thermoplastics. Other materials suitable for manufacturing the shingle testing tool 100 will be obvious to those of ordinary skill in the art having the benefit of this disclosure.

In one or more embodiments, the inclined shingle support plate 101 defines one or more shingle structural reliability measurement graduations 109,110,111,112. Illustrating by example, in an explanatory embodiment the inclined shingle support plate 101 defines a plurality of shingle structural reliability measurement graduations 109,110,111,112 that indicate multiples of a predefined measurement unit that an edge of a single elevates from the base member 102, or vertical roof deck upon which the base member 102 is positioned, as the shingle slides up the inclined shingle support plate 101 from the leading convex edge 105. For instance, in one embodiment the plurality of shingle structural reliability measurement graduations 109,110,111,112 consists of four shingle structural reliability measurement graduations with each graduation indicating a multiple of a predefined measurement unit of one inch of elevation that occurs as an edge of the shingle translates up the inclined shingle support plate 101 from the leading convex edge 105. Other numbers of measurement graduations and predefined measurement units will be obvious to those of ordinary skill in the art having the benefit of this disclosure.

The shingle structural reliability measurement graduations 109,110,111,112 can be manufactured in any of a number of ways. In the illustrative embodiment of FIGS. 1-8 each of the shingle structural reliability measurement graduations 109,110,111,112 is configured as a straight line spanning the width of the inclined shingle support plate 101. In this illustrative embodiment, each of the shingle structural reliability measurement graduations 109,110,111,112 is tooled into the inclined shingle support plate 101 as a recessed detent. Configuring the shingle structural reliability measurement graduations 109,110,111,112 in this manner allows a shingle edge to pass over the shingle structural reliability measurement graduations 109,110,111,112.

In one or more embodiments, the shingle structural reliability measurement graduations 109,110,111,112 are included to allow the user to view the amount of shingle lift, or elevation of the shingle's edge, from the surface upon which the base member 102 is resting. Placing these shingle structural reliability measurement graduations 109,110,111,112 on the inclined shingle support plate 101 allows this measurement of elevation of the shingle's edge to be easily viewed from the top of the inclined shingle support plate 101. In one or more embodiments, the shingle structural reliability measurement graduations 109,110,111,112 are recessed to ensure smooth travel of a shingle along the inclined shingle support plate 101 without interference.

While the decorative indicia 401 is illustrated as protruding from central locations along the inclined shingle support plate 101 in one explanatory embodiment, in other embodiments the decorative indicia 401 will be moved to the top end of the inclined shingle support plate 101 to remove any obstacles that may prevent smooth, unobstructed travel of a shingle along the inclined shingle support plate 101. Moreover, it should be noted that in other embodiments, these decorative indicia 401 will not be placed upon the inclined shingle support plate 101. In other embodiments, the location of the decorative indicia 401 will likely be moved to another portion of the shingle testing tool 100. In many embodiments, regardless of where the decorative indicia 401 is placed, it is created as recessed indicia applied by stamping, laser etching, or screen printing. Making the decorative indicia 401 recessed advantageously prevents snagging, scratching, or hindering of the proper usage of the shingle testing tool 100.

The shingle structural reliability measurement graduations 109,110,111,112 could be manufactured in other ways as well. Illustrating by example, in another embodiment the shingle structural reliability measurement graduations 109,110,111,112 are tooled into the inclined shingle support plate 101 as protrusions that extend distally away from the surface of the inclined shingle support plate 101. In still other embodiments, the shingle structural reliability measurement graduations 109,110,111,112 are printed, painted, or otherwise disposed along the surface of the inclined shingle support plate 101. Other techniques for constructing the shingle structural reliability measurement graduations 109,110,111,112 will be obvious to those of ordinary skill in the art having the benefit of this disclosure.

As best shown in FIGS. 2 and 3, in one or more embodiments the shingle testing tool 100 comprises one or more side panels 201,301 that span one or both of a first side 113 and/or a second side 114 of the base member 102, the inclined shingle support plate 101, and the rear support member 103. For example, as shown in FIG. 2 in one or more embodiments the shingle testing tool 100 includes a first side panel 201 spanning the first side 113 of each of the base member 102, the inclined shingle support plate 101, and the rear support member 103. Similarly, as shown in FIG. 3, a second side panel 301 can span the second side 114 of each of the base member 102, the inclined shingle support plate 101, and the rear support member 103.

In one or more embodiments, each of the first side panel 201 and the second side panel 301 define an aperture 202,302. Such an aperture 202,302 can make the shingle testing tool 100 easier to hold and use. The inclusion of the aperture 202,302 can make the shingle testing tool 100 lighter as well.

In the illustrative embodiment of FIGS. 1-8, the aperture 202,302 defined by the first side panel 201 and the second side panel 301 is substantially triangular in shape. In one embodiment, each aperture 202,302 can be bounded by a perimeter shaped as a triangle with rounded corners. However, embodiments of the disclosure are not so limited. Numerous other shapes for each aperture 202,302—where included—will be obvious to those of ordinary skill in the art having the benefit of this disclosure. Illustrating by example, each aperture 202,302 could be configured as a circle, a rectangle, a polygon, or in a free-form shape in other embodiments.

In one or more embodiments, each aperture 202,302 has a central axis 203,303 that is oriented substantially orthogonally with other axes, e.g., axes 204,205, passing normally through the base member 102, the inclined shingle support plate 101, and the rear support member 103, respectively. This occurs when the aperture 202 in the first side panel 201 and the aperture 302 in the second side panel 301 are of the same size and have central axes 203,303 that are collinear. In other embodiments, one of the aperture 202 of the first side panel 201 or the aperture 302 of the second side panel 301 will be larger or smaller than the other, or will have central axes that are parallel but not collinear. Other configurations for the apertures 202,302 will be obvious to those of ordinary skill in the art having the benefit of this disclosure.

In one or more embodiments, to make shingle structural reliability measurements easier to see from the sides of the shingle testing tool 100, which may be necessary when a shingle is positioned along the inclined shingle support plate 101, one or both of the first side panel 201 and/or the second side panel 301 can include one or more measurement indicators. In one or more embodiments, each of the first side panel 201 and the second side panel 301 include at least two sets of measurement indicators.

Illustrating by example, in one or more embodiments a first portion 207 of the first side panel 201 and/or a first portion 307 of the second side panel 301 can include one or more first portion measurement indicators 209,210,211,212. In the illustrative embodiment of FIGS. 1-8, at least some of the first portion measurement indicators 209,210,211,212 situated on the first portion 207 of the first side panel 201 extend distally from the one or more shingle structural reliability measurement graduations 109,110,111,112 positioned on the inclined shingle support plate 101. Accordingly, each of some of the one or more first portion measurement indicators 209,210,211,212 situated on the first portion 207 of the first side panel 201 extends distally from the one or more shingle structural reliability measurement graduations 109,110,111,112 on a one-to-one basis in one or more embodiments.

Similarly, a second portion 206 of the first side panel 201 and/or a second portion 306 of the second side panel 301 can include a plurality of first portion measurement indicators 309,310,311,312. As with the first portion measurement indicators 209,210,211,212 situated on the first portion 207 of the first side panel 201, in one or more embodiments at least some of the first portion measurement indicators 309, 310,311,312 situated on the first portion 307 of the second side panel 301 can extend distally from the one or more shingle structural reliability measurement graduations 109, 110,111,112 positioned on the inclined shingle support plate 101 as well. Accordingly, each of some of the one or more first portion measurement indicators 309,310,311,312 situated on the first portion 307 of the second side panel 301 extends distally from the one or more shingle structural reliability measurement graduations 109,110,111,112 on a one-to-one basis in one or more embodiments.

As shown in the illustrative embodiment of FIGS. 2-3, in one or more embodiments the measurement indicators situated on one or both of the first portion 207 of the first side panel 201 and/or the first portion 307 of the second side panel 301 include more measurement indicators than there are shingle structural reliability measurement graduations 109, 110, 111, 112 positioned on the inclined shingle support plate 101. Illustrating by example, in this illustrative embodiment one or more additional first portion measurement indicators 213, 214, 215, 216 are positioned along the first portion 207 of the first side panel 201, with these one or more additional first portion measurement indicators 213, 214, 215, 216 being positioned half way between the one or more first portion measurement indicators 209, 210, 211, 212 (with the exception of additional first portion measurement indicators 216, which is positioned beyond first portion measurement indicators 212 from the leading convex edge 105).

Similarly, in this illustrative embodiment one or more additional first portion measurement indicators 313, 314, 315, 316 are positioned along the first portion 307 of the second side panel 301, with these one or more additional first portion measurement indicators 313, 314, 315, 316 being positioned half way between the one or more first portion measurement indicators 309, 310, 311, 312 (with the exception of additional first portion measurement indicators 316, which is positioned beyond first portion measurement indicators 312 from the leading convex edge 105).

In this illustrative embodiment, each of the first portion measurement indicators 209,210,211,212 situated on the first portion 207 of the first side panel 201 and the first portion measurement indicators 309,310,311,312 situated on the first portion 307 of the second side panel 301 are situated in one-inch increments indicating an elevation height from the base member 102 at which a shingle edge would situate if it slid up the inclined shingle support plate 101 from the leading convex edge 105. To indicate this fact, in one or more embodiments the first portion 207 of the first side panel further comprises numerical indicia 217,218,219,220 positioned adjacent to the first portion measurement indicators 209,210,211,212 situated on the first portion 207 of the first side panel 201. In this illustrative embodiment, the numerical indicia 217,218,219,220 comprise the numbers "1," "2," "3," and "4," which indicate elevation measurements of one-inch, two-inches, three-inches, and four-inches, respectively. The first portion 307 of the second side panel 301 can be similarly configured, with numerical indicia 317,318,319, 320 also indicating elevation measurements of one-inch, two-inches, three-inches, and four-inches, respectively. Just for clarity, this bears repeating: These are measurements of elevation from the base member 102. They are not measurements of distance along the inclined shingle support plate 101 from the leading convex edge 105.

In this illustrative embodiment, each of the one or more additional first portion measurement indicators 213, 214, 215, 216 situated on the first portion 207 of the first side panel 201 and the one or more additional first portion measurement indicators 313, 314, 315, 316 situated on the first portion 307 of the second side panel 301 are situated in one-half inch increments from their surrounding first portion measurement indicators 209, 210, 211, 212, 309, 310, 311, 312. Numerical indicia (not shown) could be placed adjacent to these additional first portion measurement indicators 213, 214, 215, 216, 313, 314, 315, 316 as well.

While these explanatory measurements constitute one measurement indication that can be provided by the first portion measurement indicators 209,210,211,212,309,310, 311,312 and the additional first portion measurement indicators 213,214,215,216,313,314,315,316, embodiments of the disclosure are not so limited. Other measurement indications will be obvious to those of ordinary skill in the art having the benefit of this disclosure. For example, the first portion 207 of the first side panel 201 and the first portion 307 of the second side panel 301 can have more additional first portion measurement indicators 209,210,211,212,309, 310,311,312 than those shown in FIGS. 2 and 3, or fewer. The same is true with the shingle structural reliability measurement graduations 109,110,111,112. Other numbers of shingle structural reliability measurement graduations 109,110,111,112, which may be more than the four shown in FIGS. 1-8 or fewer, can be used as well.

As best shown in FIG. 8, in one or more embodiments a major surface 801 of the base member 102 facing the inclined shingle support plate 101 can also include a plurality of base member measurement indicators 809,810,811, 812. In the illustrative embodiment of FIG. 8, each base member measurement indicators of the plurality of base member measurement indicators 809,810,811,812 are arranged in a coplanar relationship with at least one first portion measurement indicator of the first portion measurement indicators 209,210,211,212,309,310,311,312 positioned on the first side panel 201 and/or the second side panel 301.

Illustrating by example, FIG. 8 depicts the first portion measurement indicators 309,310,311,312 positioned on the first portion 307 of the second side panel 301, with one first portion measurement indicators of the first portion measurement indicators 309,310,311,312 arranged in a coplanar relationship 802 with one base member measurement indicator of the plurality of base member measurement indicators 809,810,811,812. Since each base member measurement indicators of the plurality of base member measurement indicators 809,810,811,812 is arranged in a coplanar relationship with at least one first portion measurement indicator of the first portion measurement indicators 209,210,211,212,309,310,311,312 positioned on the first side panel 201 and/or the second side panel 301, in this illustrative embodiment the base member measurement indicators 809,810,811,812 are also arranged in a coplanar relationship 802 with the shingle structural reliability measurement graduations 109,110,111,112 as well.

As with the first portion measurement indicators 309,310, 311,312, numerical indicia 817,818,819,820 can optionally be positioned adjacent to the base member measurement indicators 809,810,811,812 situated on the major surface 801 of the base member 102. In this illustrative embodiment, the numerical indicia 817,818,819,820 again comprise the numbers "1," "2," "3," and "4," which indicate measurements of one-inch, two-inches, three-inches, and four-inches, respectively, of elevation from the base member 102. Again, for clarity, these measurements are elevation measurements. They are not distance measurements from the leading convex edge 105. Other examples of numerical indicia 817,818,819,820 or other information suitable for placement on the major surface 801 of the base member 102 will be obvious to those of ordinary skill in the art having the benefit of this disclosure.

In one or more embodiments, a second portion 206 of the first side panel 201 extending from the first side 113 of the base member 102 includes a plurality of second portion measurement indicators 221,222,223. In one or more embodiments, at least some of the second portion measurement indicators of the plurality of second portion measurement indicators 221,222,223 are co-linear with at least some of the first portion measurement indicators 209,210,211,212 on a one-to-one basis. Illustrating by example, in one or more embodiments second portion measurement indicators 224,225,226,227 are co-linear with first portion measurement indicators 209,210,211,212. The remaining second portion measurement indicators of the plurality of second portion measurement indicators 221,222,223 then define a ruler, measuring quarter inch increments in this example, extending along the second side 114 of the first side panel 201 from the first end 104 of the base member 102 to the second end 107 of the base member 102. As shown in FIG. 3, the second side 114 of the shingle testing tool 100 can be similarly configured.

As best shown in FIG. 5, in one or more embodiments the rear support member 103 defines an arched aperture 501. The inclusion of the arched aperture 501 helps to reduce the overall weight of the shingle testing tool 100 without compromising performance. Configuring openings in the rear support member 103 as an arch offers additional strength to the shingle testing tool 100 due to the strength that an arch can provide. The arched aperture 501 also adds additional aesthetics and printability when the shingle testing tool 100 is manufactured using a three-dimensional printing process to construct the shingle testing tool 100 from polylactic acid or polylactide filament. Other advantages of including the arched aperture 501 will be obvious to those of ordinary skill in the art having the benefit of this disclosure.

In one or more embodiments, the arched aperture 501 defines a convex contour 502 that extends toward the distal end 108 of the inclined shingle support plate 101. In one or more embodiments, an apex 503 of the arched aperture 501 is situated closer to the distal end 108 of the inclined shingle support plate 101 than to the second end 107 of the base member 102. The inclusion of this convex contour 502, which is optional, provides additional mechanical stability when forces are applied to the distal end 108 of the inclined shingle support plate 101 with those forces directed toward the base member 102.

In one or more embodiments, to make carrying the shingle testing tool 100 easier, the rear support member 103 can define a karabiner attachment port 504. A karabiner (not shown) can be passed through the aperture 302 positioned in the second side panel 301 and through the karabiner attachment port 504 to secure the shingle testing tool 100 to the karabiner. Alternatively, a karabiner can be passed through the karabiner attachment port 504 and through another aperture situated in the rear support member 103, one example of which is the decorative aperture 505 shown in FIG. 5. Other mechanisms for attaching a karabiner, rope, lanyard, or other carrying strap to the shingle testing tool 100 will be obvious to those of ordinary skill in the art having the benefit of this disclosure.

In one or more embodiments, decorative or branding indicia can be positioned on one or more of the inclined shingle support plate 101, the base member 102, and/or the rear support member 103. Illustrating by example, as shown in FIG. 4, in one or more embodiments decorative indicia 401 can be positioned along the inclined shingle support plate 101. In this example, the decorative indicia 401 comprise branding information identifying a manufacturer of the shingle testing tool 100. However, embodiments of the disclosure are not so limited. In other embodiments, the decorative indicia 401 can be replaced with instructional indicia indicating how to use the shingle testing tool 100. In still other embodiments, the decorative indicia 401 can comprise personalization indicia indicating a company, owner of the shingle testing tool 100, or other information.

To provide explanatory, but non-limiting, examples of dimensions in accordance with which the shingle testing tool 100 can be manufactured, in one or more embodiments the inclined shingle support plate 101 is between five and six inches in length. For instance, in one embodiment, the length of the inclined shingle support plate 101 is between 5.5 inches and 6.0 inches. In one embodiment, the length of the inclined shingle support plate 101 is 5.85 inches.

In one or more embodiments, the base member 102 is between five and six inches in length. For instance, in one embodiment, the length of the base member 102 is between 5.0 inches and 6.5 inches. In one embodiment, the length of the base member 102 is 5.35 inches.

In one or more embodiments, the rear support member 103 is between four and five inches in length. For instance, in one embodiment, the length of the rear support member 103 is between 4.5 inches and 5.0 inches. In one embodiment, the length of the rear support member is 4.76 inches.

In one or more embodiments, the width of the inclined shingle support plate 101 is between 1.9 inches and 2.0 inches. In one embodiment, the width of the inclined shingle support plate 101 is 1.94 inches, with the first portion measurement indicators 209,210,211,212,309,310,311,312 extending distally by another 0.055 inches from the first side 113 and the second side 114 of the shingle testing tool 100, respectively.

In one or more embodiments, the width of the arched aperture 501 is between one and two inches. For instance, in one or more embodiments the width of the arched aperture 501 is between 1.5 and 1.75 inches. In one embodiment, the width of the arched aperture 501 is 1.56 inches. In one or more embodiments, the width of the base member 102 and the rear support member 103 is two inches. The remaining measurements can be obtained mathematically from these measurements in combination with the description above. Additionally, these measurements are explanatory only, as others will be obvious to those of ordinary skill in the art having the benefit of this disclosure.

As shown and described with reference to FIGS. 1-8, in one or more embodiments a shingle testing tool 100 comprises a base member 102 that serves as a base for the shingle testing tool 100 and defines a substantially planar surface. An inclined shingle support plate 101 intersects this base to define a single wedge. (As used herein, a "single" wedge takes the ordinary mechanical definition distinguishing single wedges from "double" wedges due to the fact that placement of two of the shingle testing tools with their base members abutting, with each shingle testing tool defining a single wedge, would create a double wedge.)

In one or more embodiments, this single wedge defined by the base member 102 and the inclined shingle support plate 101 has a leading edge defined by the leading convex edge 105 that is between forty-five degrees and fifty-five degrees, inclusive. For example, in one or more embodiments the leading edge defined by the inclined shingle support plate 101 and the base member 102 has an angle of between forty-nine degrees and fifty-one degrees. In one embodiment, the leading edge defined by the inclined shingle support plate 101 and the base member 102 has an angle of about fifty degrees.

It should be noted that embodiments of the disclosure could be manufactured with other angles defined by the inclined shingle support plate 101 and the base member 102 as well. Illustrating by example, if the angle is forty-five degrees, the measurement indicators on the inclined shingle support plate 101 and the measurement indicators on the base member 102 more easily align due to the fact that regular measurement demarcations occur at a 1:1 ratio. One downside with defining the angle to be forty-five degrees rather than fifty is that the reduced angle lessens the clearance of hammer swing by 0.363121 inches, which is nearly three eighths of an inch. This amount can be significant considering the clearance is generally less than 1.5 inches. When the angle is set to fifty-five degrees, the clearance is seven tenths of an inch, which is easier to work with than 0.834 inches. At sixty degrees, the clearance is 0.577 inches, which some may consider to be too aggressive. Accordingly, most practitioners will prefer an angle of about fifty degrees. However, other angles will be obvious to those of ordinary skill in the art having the benefit of this disclosure.

As described above, in one or more embodiments the inclined shingle support plate 101 defines a plurality of measurement graduations indicating multiples of a predefined measurement unit of elevation that a shingle's edge would experience when situated at a particular location along the inclined shingle support plate 101 from the leading edge. In the illustrative embodiment of FIGS. 1-8, this plurality of measurement graduations comprises the four shingle structural reliability measurement graduations 109, 110,111,112, with the predefined measurement unit consisting of one inch increments of elevation from the base member 102.

As also described above, a first side panel 201 spans a first side 113 of the base and the inclined shingle support plate 101. Similarly, a second side panel 301 spans a second side 114 of the base and inclined shingle support plate 101. In the illustrative embodiment of FIGS. 1-8, each of the first side panel 201 and the second side panel 301 define an aperture having a central axis 203 oriented substantially orthogonally with other axes 204,205 passing through the base and the inclined shingle support plate 101, respectively. Additionally, each of the first side panel 201 and the second side panel 301 define four side panel portion measurement indicators as previously described. Each extends from shingle structural reliability measurement graduations 109,110,111, 112 on a one-to-one basis in one or more embodiments.

In one or more embodiments, these various measurement indicators can be used to determine how far up the inclined shingle support plate 101 a shingle will slide, and therefore how high the shingle's edge will lift, when the shingle testing tool 100 is positioned between a first shingle and a second shingle of a roof with the leading convex edge 105 inserted until the shingle testing tool 100 stops. In addition to measuring how far up the inclined shingle support plate 101 a shingle will slide, and therefore the elevation of its edge, when the shingle testing tool 100 is positioned between a first shingle and a second shingle of a roof, in one or more embodiments the second portion 206 of the first side panel 201 and/or the second side panel 301 includes additional measurement indicators defining a ruler extending along the second portion 206 of the first side panel 201 and/or second side panel 301 from the first end 104 of the base member 102 to the second end 107 of the base member 102.

As will be described in more detail below with reference to FIGS. 9 and 10, in one or more embodiments a method of using the shingle testing tool 100 includes determining whether a nail passing through the shingle abutting the base member 102 when the shingle testing tool 100 is placed between a first shingle and a second shingle is exposed beyond the second end 107 of the base member 102. Where it is not, the measurement indicators defining the ruler allow an inspector to quickly determine how far from the edge or butt of a shingle the nail is positioned when the shingle testing tool 100 is maximally inserted between the first shingle and the second shingle.

The shingle testing tool 100 of FIGS. 1-8, by insertion of the leading convex edge 105, can be used to easily lift the bottom edge of a shingle for sliding the inclined shingle support plate 101 under the lifted shingle edge portion. By being configured as a single wedge, the shingle testing tool 100 can be deployed as a wedging member for sliding under the bottom edge portion of a shingle. In one or more embodiments, the shingle testing tool 100 is specifically designed to raise the bottom edge of the shingle to create enough of a space to slide the inclined shingle support plate 101 under the raised shingle. The amount the inclined shingle support plate 101 can be slid under the shingle and/or the distance a nail in the shingle below is positioned from the shingle butt can be used to determine whether a damaged shingle situated beneath the lifted shingle can be replaced without damaging the lifted shingle.

Figure 21:
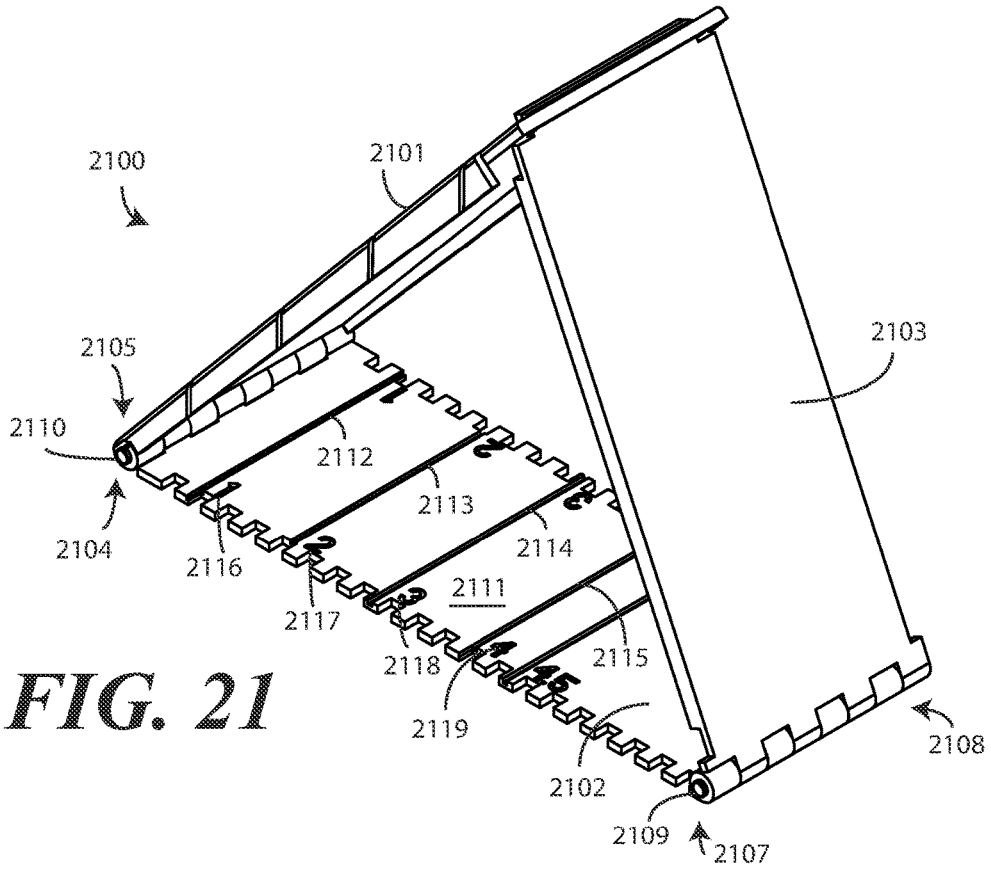
FIG. 21 illustrates a perspective view of yet another explanatory shingle testing tool configured in accordance with one or more embodiments of the disclosure.
Figure 22:
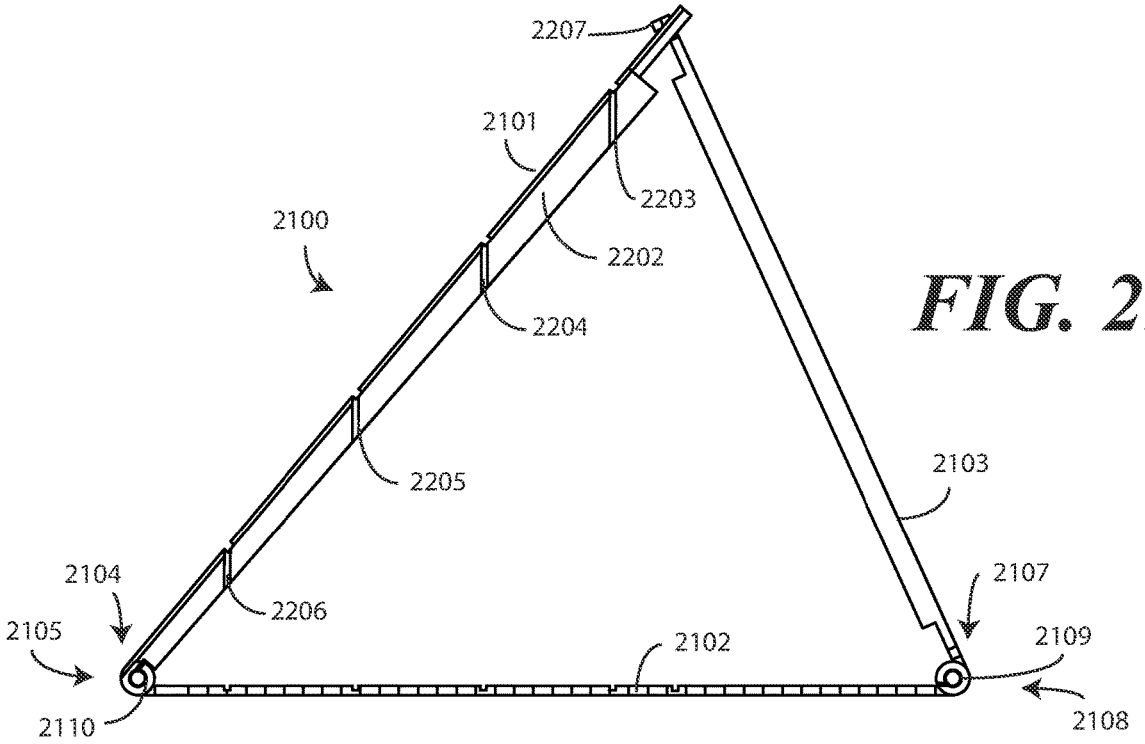
FIG. 22 illustrates a side elevation view of the shingle testing tool of FIG. 21.
Figure 23:
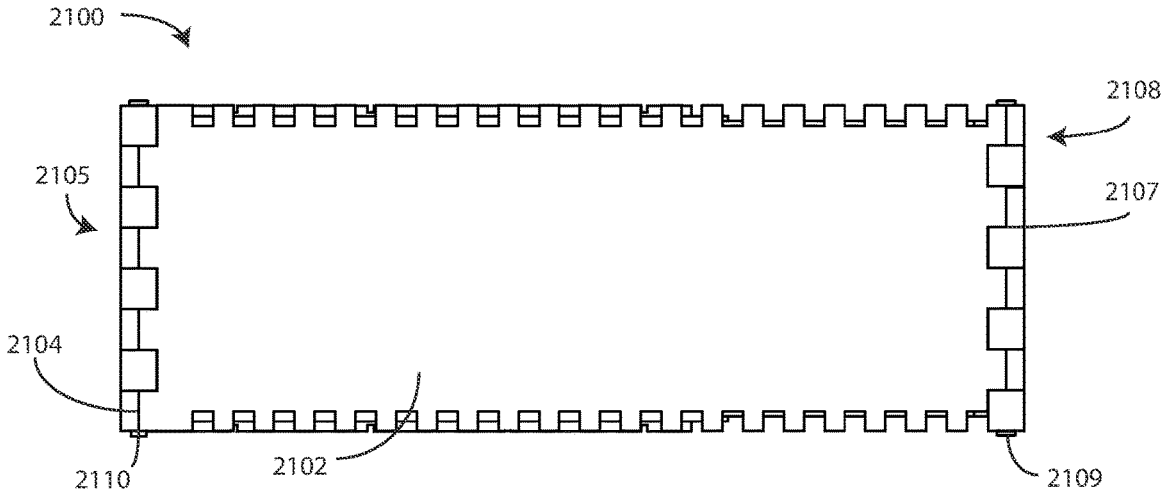
FIG. 23 illustrates a bottom plan view of the shingle testing tool of FIG. 21.
Figure 24:
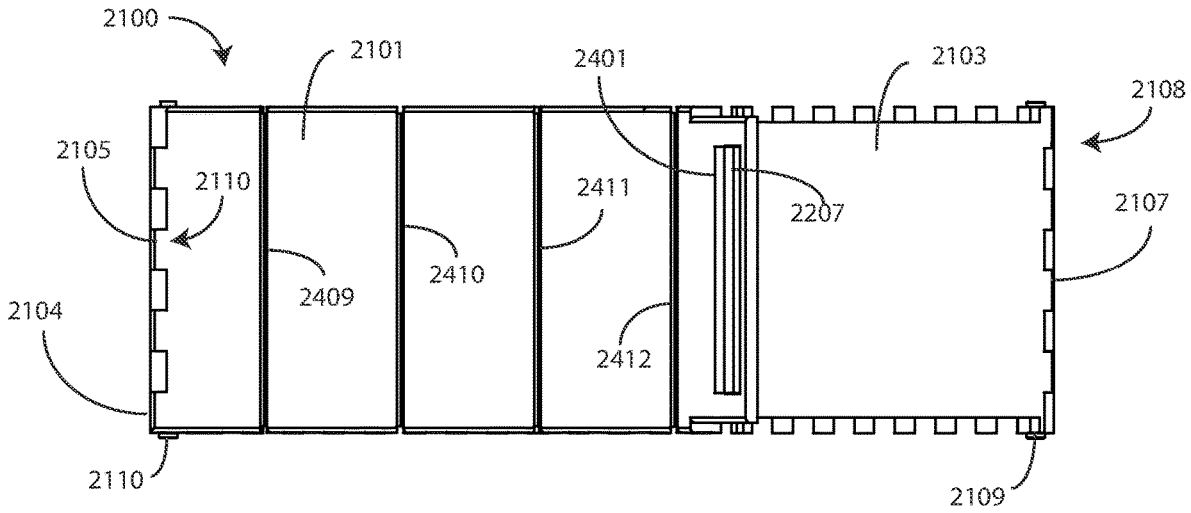
FIG. 24 illustrates a top plan view of the shingle testing tool of FIG. 21.

Turning now to FIGS. 21-24, illustrated therein is another explanatory shingle testing tool 2100 configured in accordance with one or more embodiments of the disclosure. FIG. 21 illustrates a perspective view of the shingle testing tool 2100, while FIG. 22 illustrates a left side elevation view of the shingle testing tool 2100. FIG. 23 illustrates a bottom plan view of the shingle testing tool 2100, while FIG. 24 illustrates a top plan view of the shingle testing tool 2100.

In one or more embodiments, the shingle testing tool 2100 comprises an inclined shingle support plate 2101, a base member 2102, and a rear support member 2103. In one or more embodiments, the inclined shingle support plate 2101 and the base member 2102 intersect at a first end 2104 of the base member 2102 to define a leading convex edge 2105. The rear support member 2103 then intersects a second end 2107 of the base member 2102 to define a trailing convex edge 2108.

In one embodiment, the shingle testing tool 2100 is configured as a collapsible element due to the fact that the inclined shingle support plate 2101 and the rear support member 2103 interlock at their distal ends from the base member 2102. In this illustrative embodiment, the interlock is created when a tongue 2207 extending from the rear support member 2103 inserts within a slot 2401 defined by a distal end of the inclined shingle support plate 2101. By slightly lifting the inclined shingle support plate 2101 above the distal end of the tongue 2207, the tongue can be inserted into, or removed from, the slot 2401. Gravity, pulling each of the inclined shingle support plate 2101 and the rear support member 2103 toward the base member 2102 then interlocks the shingle testing tool 2100 in the triangular position shown in FIGS. 21-14.

This interlocking arrangement can then be unlocked to allow the rear support member 2103 to initially pivot relative to the base member 2102 about a first hinge 2109 to collapse atop the base member 2102. Similarly, the inclined shingle support plate 2101 can then pivot relative to the base member 2102 about a second hinge 2110 to collapse atop the rear support member 2103. This allows the shingle testing tool 2100 to collapse from the interlocked and erect version of FIGS. 21-24 to a flat configuration that fits more readily in a tote bag or pocket.

In one or more embodiments, the inclined shingle support plate 2101 defines one or more shingle structural reliability measurement graduations 2409,2410,2411,2412. Illustrating by example, in an explanatory embodiment the inclined shingle support plate 2101 defines a plurality of shingle structural reliability measurement graduations 2409,2410, 2411,2412 that indicate multiples of a predefined measurement unit of elevation that a shingle's edge would experience when situated at a particular location along the inclined shingle support plate 2101 from the leading convex edge 2105. For instance, in one embodiment the plurality of shingle structural reliability measurement graduations 2409, 2410,2411,2412 consists of four shingle structural reliability measurement graduations with each graduation indicating a multiple of a predefined measurement unit of one inch of elevation from the base member 2102, or increments of elevation at which a shingle edge would situate as it slid up the inclined shingle support plate 2101 from the leading convex edge 2105. Other numbers of measurement graduations and predefined measurement units will be obvious to those of ordinary skill in the art having the benefit of this disclosure.

As best shown in FIG. 22, in one or more embodiments the shingle testing tool 2100 comprises one or more side panels 2202 that span one or both of a first side and/or a second side of the inclined shingle support plate 2101. For example, in one or more embodiments the shingle testing tool 2100 includes a first side panel 2202 spanning the first side of the inclined shingle support plate 2101 and a second side panel that spans the second side of the inclined shingle support plate 2101.

In one or more embodiments, to make shingle structural reliability measurements easier to see from the sides of the shingle testing tool 2100, which may be necessary when a shingle is positioned along the inclined shingle support plate 2101, one or both of the first side panel 2202 and/or the second side panel (which is a mirror image of the first side panel 2202) can include one or more measurement indicators. In one or more embodiments, each of the first side panel 2202 and the second side panel include a single set of measurement indicators. In other embodiments, each of the first side panel 2202 and the second side panel include additional sets of measurement indicators.

Illustrating by example, in one or more embodiments the first side panel 2202 and/or the second side panel can include one or more measurement indicators 2203,2204,2205,2206 extending distally from the one or more shingle structural reliability measurement graduations 2409,2410,2411,2412 positioned on the inclined shingle support plate 2101. Accordingly, each of some of the one or more measurement indicators 2203,2204,2205,2206 situated on the first side panel 2202 extends distally from the one or more shingle structural reliability measurement graduations 2409,2410, 2411,2412 on a one-to-one basis in one or more embodiments.

In this illustrative embodiment, each of the measurement indicators 2203,2204,2205,2206 situated on the first side panel 2202 and the measurement indicators situated on the second side panel are situated in one-inch increments of elevation from the base member 2102. While these explanatory measurements constitute one measurement indication that can be provided by the measurement indicators 2203, 2204,2205,2206, embodiments of the disclosure are not so limited. Other measurement indications will be obvious to those of ordinary skill in the art having the benefit of this disclosure. For example, the more or fewer measurement indicators 2203,2204,2205,2206 than those shown in FIG. 22 can be included.

As best shown in FIG. 21, in one or more embodiments a major surface 2111 of the base member 2102 facing the inclined shingle support plate 2101 can also include a plurality of base member measurement indicators 2112, 2113,2114,2115. In the illustrative embodiment of FIGS. 21-24, each base member measurement indicators of the plurality of base member measurement indicators 2112, 2113,2114,2115 are arranged in a coplanar relationship with at least one first portion measurement indicator of the measurement indicators 2203,2204,2205,2206 positioned on the side panel 2202.

Illustrating by example, FIG. 21 depicts the measurement indicators 2203,2204,2205,2206 positioned on the side panel 2202, with those measurement indicators 2203,2204, 2205,2206 arranged in a coplanar relationship (802) with one base member measurement indicator of the plurality of base member measurement indicators 2112,2113,2114,2115. Since each base member measurement indicators of the plurality of base member measurement indicators 2112, 2113,2114,2115 is arranged in a coplanar relationship with at least one first portion measurement indicator of the measurement indicators 2203,2204,2205,2206 positioned on the side panel 2202, in this illustrative embodiment the base member measurement indicators 2112,2113,2114,2115 are also arranged in a coplanar relationship (802) with the shingle structural reliability measurement graduations 2409, 2410,2411,2412 as well.

Numerical indicia 2116,2117,2118,2119 can optionally be positioned adjacent to the base member measurement indicators 2112,2113,2114,2115 situated on the major surface 2111 of the base member 2102. In this illustrative embodiment, the numerical indicia 2116,2117,2118,2119 comprise the numbers "1," "2," "3," and "4," with an additional "4.5" placed next to the last measurement indicator. This indicates measurements of one-inch, two-inches, three-inches, and four-inches (with an additional 4.5-inch measurement), respectively, of elevation from the base member. Other examples of numerical indicia 2116,2117,2118,2119 or other information suitable for placement on the major surface 2111 of the base member 2102 will be obvious to those of ordinary skill in the art having the benefit of this disclosure.

Figure 25:
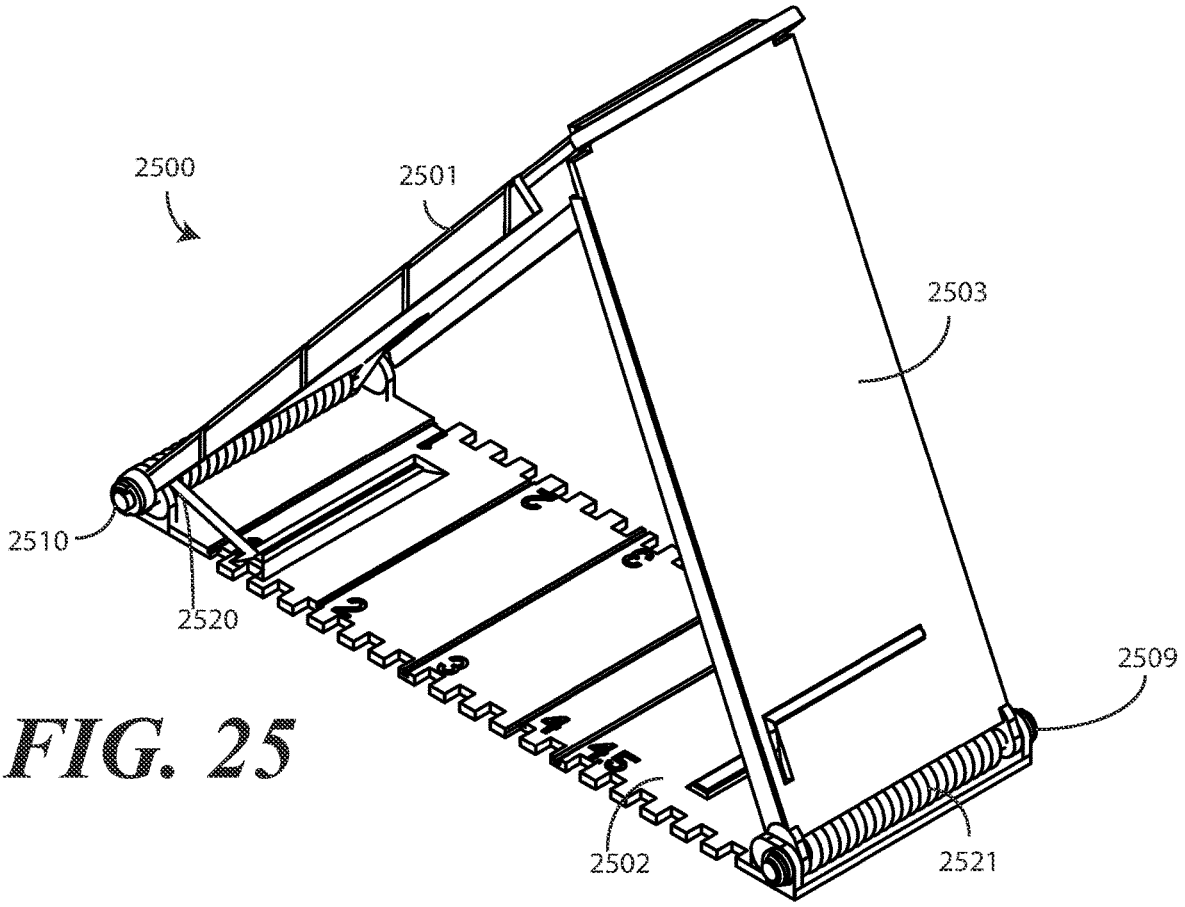
FIG. 25 illustrates still another explanatory shingle testing tool configured in accordance with one or more embodiments of the disclosure.
Figure 26:
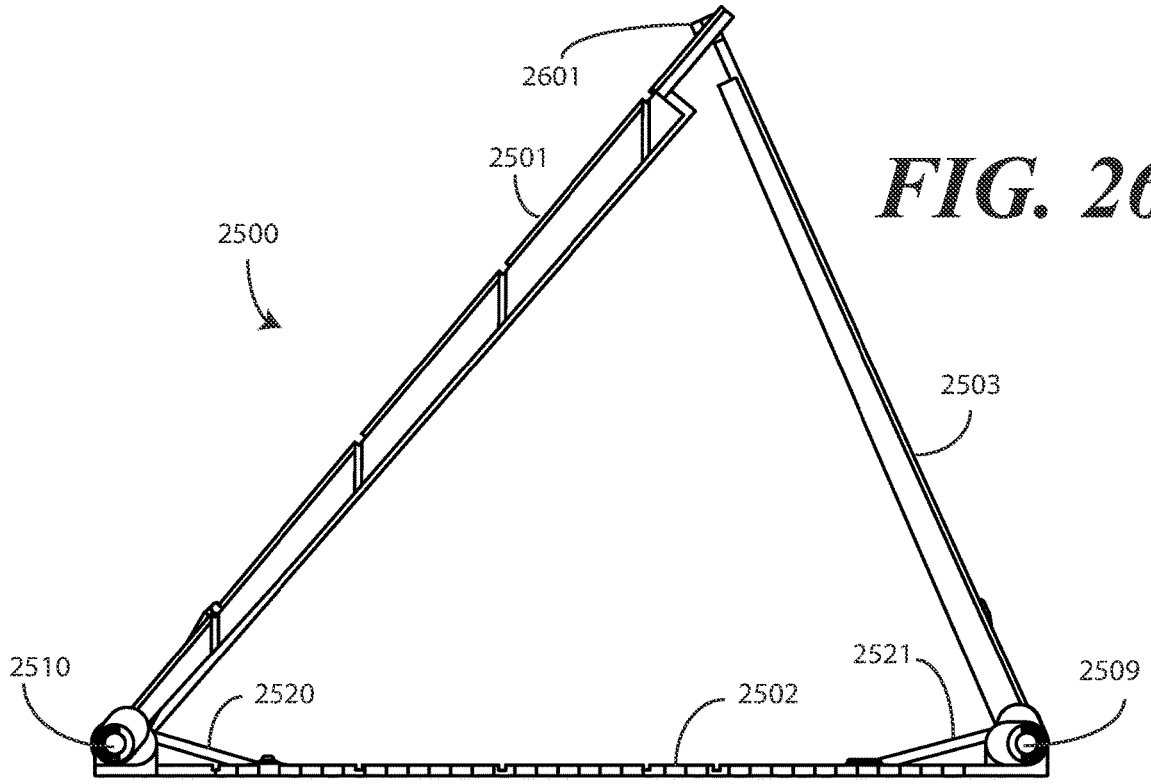
FIG. 26 illustrates a side elevation view of the shingle testing tool of FIG. 25.
Figure 27:
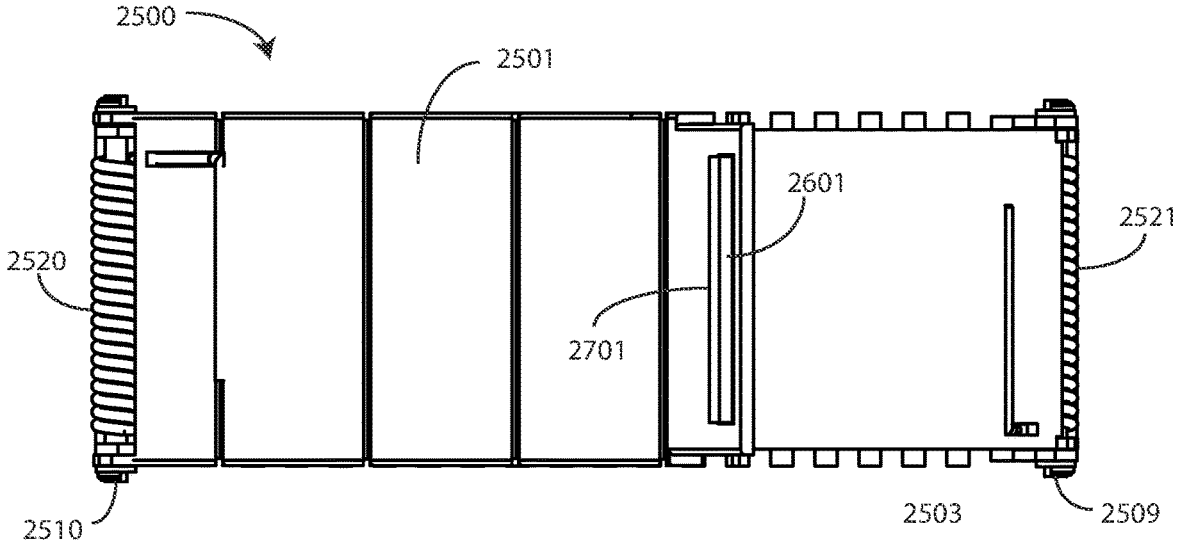
FIG. 27 illustrates a bottom plan view of the shingle testing tool of FIG. 25.
Figure 28:
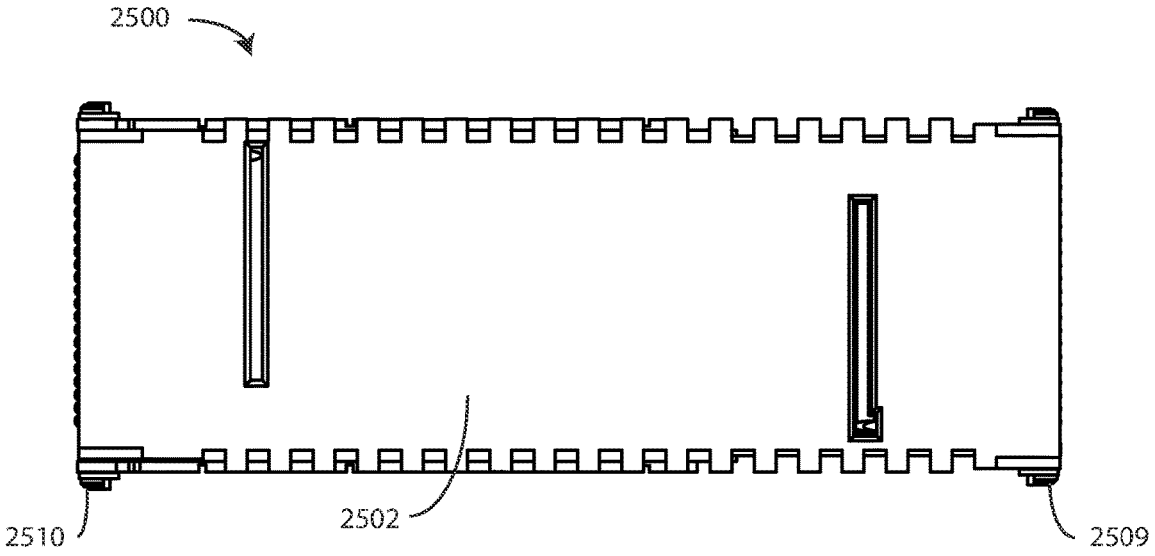
FIG. 28 illustrates a top plan view of the shingle testing tool of FIG. 25.

Turning now to FIGS. 25-28, illustrated therein is another explanatory shingle testing tool 2500 configured in accordance with one or more embodiments of the disclosure. FIG. 25 illustrates a perspective view of the shingle testing tool 2500, while FIG. 26 illustrates a left side elevation view of the shingle testing tool 2500. FIG. 27 illustrates a top plan view of the shingle testing tool 2500, while FIG. 28 illustrates a bottom plan view of the shingle testing tool 2500.

The shingle testing tool 2500 is nearly identical to the shingle testing tool (2100) of FIGS. 21-24, with one exception. That exception is that hinges 2510,2509 are positioned about the hinges 2509,2510 bias the inclined shingle support plate 2501 and the rear support member 2503 toward the base member 2502 when the tongue 2601 of the interlock is released from the slot 2701. Thus, rather than relying upon gravity to collapse the inclined shingle support plate 2501 and rear support member 2503 toward the base member 2502 to fold up the shingle testing tool 2500 when not in use, the springs 2520,2521 apply a preloading force to each of the inclined shingle support plate 2501 and the rear support member 2503 biasing the same toward the base member 2502.

In one or more embodiments, the shingle testing tool 2500 comprises an inclined shingle support plate 2501, a base member 2502, and a rear support member 2503. In one embodiment, the shingle testing tool 2500 is configured as a collapsible element due to the fact that the inclined shingle support plate 2501 and the rear support member 2503 interlock at their distal ends from the base member 2502. In this illustrative embodiment, the interlock is created when a tongue 2 601 extending from the rear support member 2503 inserts within a slot 2701 defined by a distal end of the inclined shingle support plate 2501. By slightly lifting the inclined shingle support plate 2501 (creating tension in spring 2520) above the distal end of the tongue 2601, the tongue can be inserted into, or removed from, the slot 2701. The springs 2520,2521 then bias each of the inclined shingle support plate 2501 and the rear support member 2503 toward the base member 2502 to interlock the shingle testing tool 2100 in the triangular position shown in FIGS. 21-14.

This interlocking arrangement can then be unlocked to allow the rear support member 2503 to initially pivot relative to the base member 2502 about a first hinge 2509 due to the preloading force of spring 2521 to collapse atop the base member 2502. Similarly, the inclined shingle support plate 2501 can then pivot relative to the base member 2502 about a second hinge 2510 due to the preloading force of spring 2520 to collapse atop the rear support member 2503. This allows the shingle testing tool 2500 to collapse from the interlocked and erect version of FIGS. 25-28 to a flat configuration that fits more readily in a tote bag or pocket. The remaining elements of FIGS. 25-28 are identical to those of FIGS. 21-24.

Figure 9:
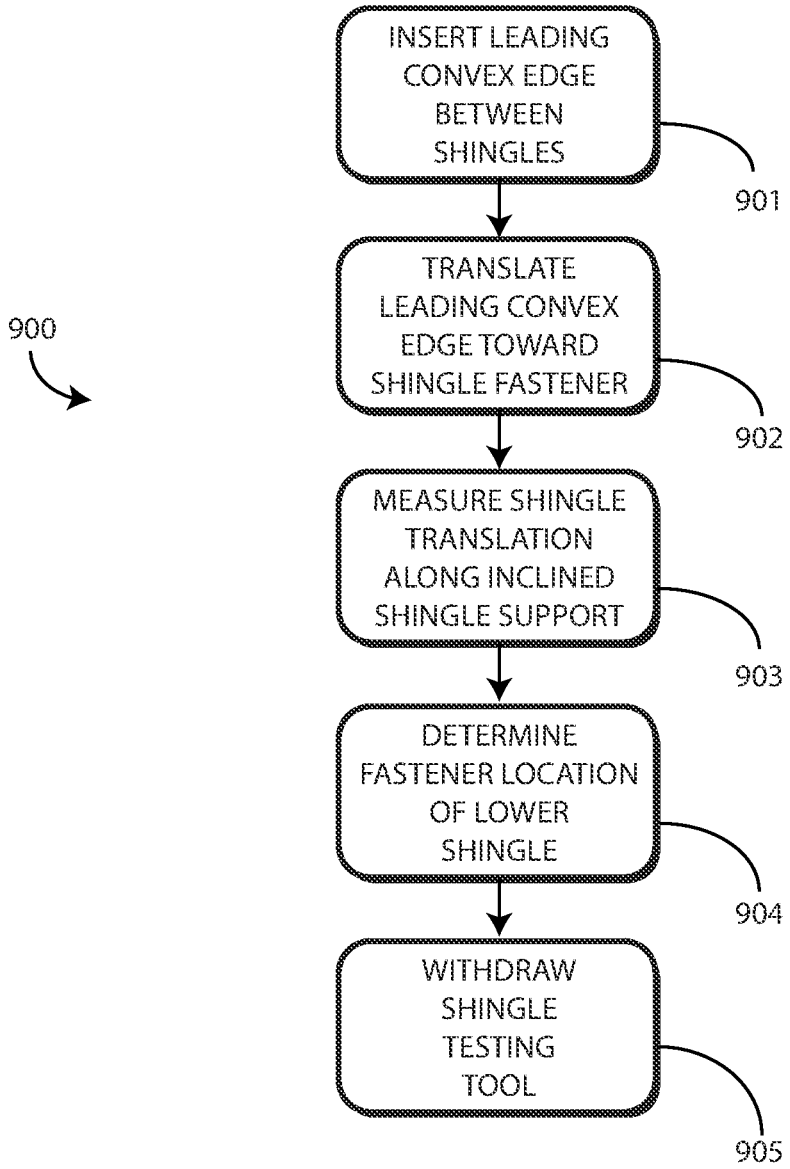
FIG. 9 illustrates one explanatory method of using a single tool in accordance with one or more embodiments of the disclosure.

Turning now to FIG. 9, illustrated therein is one explanatory general method 900 of using the shingle testing tool configured in accordance with one or more embodiments of the disclosure. Another, more specific method, will be described below with reference to FIG. 11.

Beginning at step 901, the method 900 includes inserting a convex edge of the shingle testing tool (100) positioned between a base member (102) and an inclined shingle support plate (101) between a first shingle and a second shingle. At step 902, the method 900 includes translating a convex edge of the shingle testing tool (100) toward a nail passing through the first shingle, thereby causing the first shingle to climb the inclined shingle support plate (101). In one or more embodiments, the translation of step 902 continues until the convex edge of the shingle testing tool (100) cannot be translated any further toward the nail passing through the first shingle. When this translation ceases, step 903 comprises measuring, using one or more shingle structural reliability measurement graduations (109, 110,111,112) positioned on the inclined shingle support plate (101), an amount the first shingle has climbed the inclined shingle support plate (101). This measurement indicates an elevation of the edge of the shingle from the roof.

Optional step 904 can comprise determining whether another nail passing through the second shingle is exposed beyond an end of the base member (102) located distally from the convex edge of the shingle testing tool (100). If the other nail is not exposed beyond the end of the base member (102) located distally from the convex edge of the shingle testing tool (100), step 904 can include measuring, using a plurality of second portion measurement indicators (221, 222,223,321,322,323) positioned on a first side panel 201 or a second side panel 301 of the shingle testing tool (100), how far from the convex edge of the shingle testing tool (100) the other nail is positioned. Step 905 can then comprise withdrawing the shingle testing tool (100) from between the first shingle and the second shingle.

Figure 10:
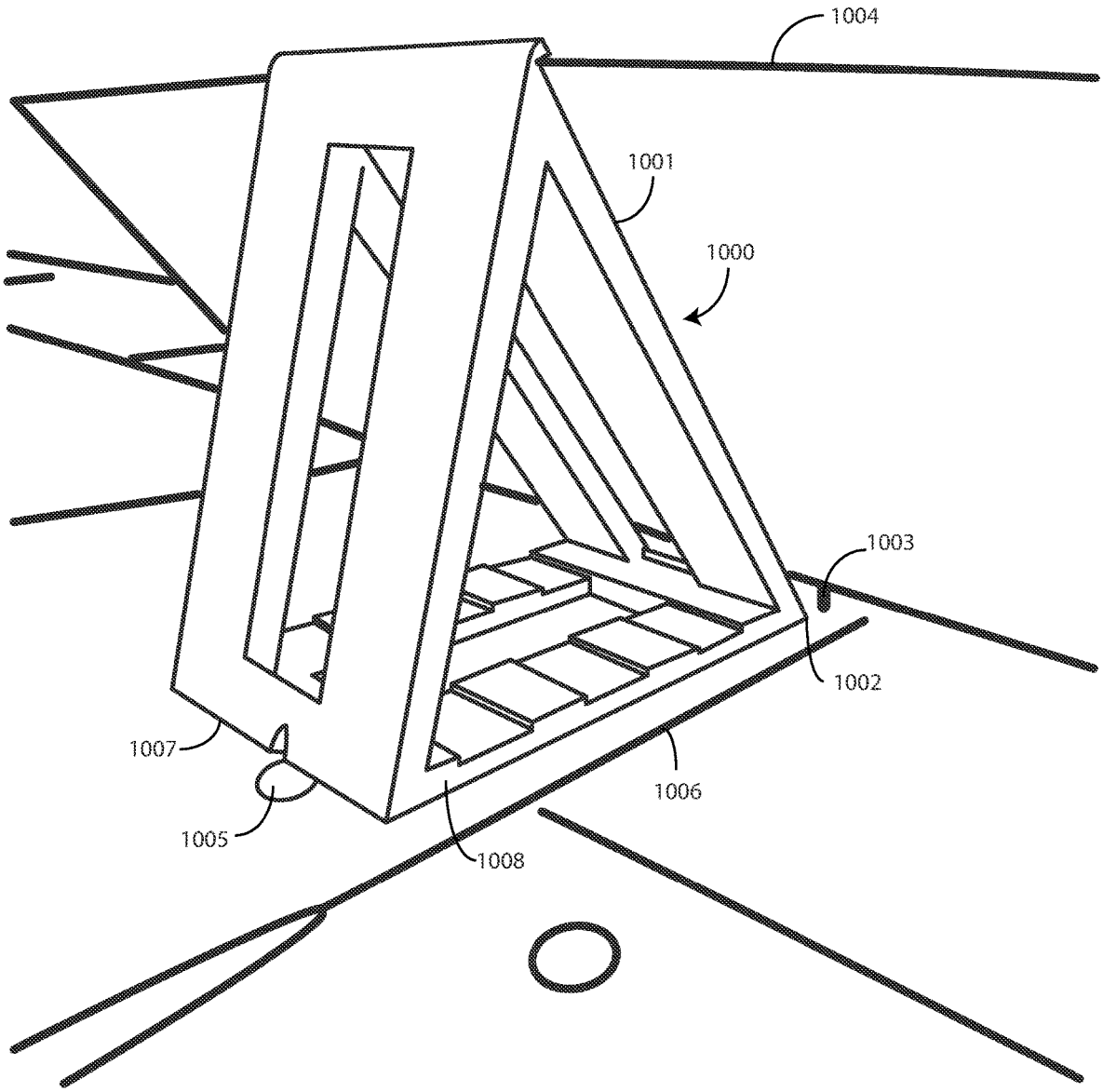
FIG. 10 illustrates one explanatory shingle tool in use in accordance with the method of FIG. 9.

Turning now to FIG. 10, illustrated therein is a shingle testing tool 1000 being used in accordance with the method (900) of FIG. 9. In FIG. 10, step (901) and step (902) have been performed, with the shingle testing tool 1000 being translated toward a nail 1003 passing through a first shingle 1004 until the convex edge 1002 of the shingle testing tool 1000 cannot be translated toward the nail 1003 any further.

At this time, an inspector can measure, using one or more shingle structural reliability measurement graduations positioned on the inclined shingle support plate 1001, an amount the first shingle 1004 has climbed the inclined shingle support plate 1001, which represents an elevation of the shingle's edge above the roof. In this example, the first shingle 1004 has climbed the entirety of the length of the inclined shingle support plate 1001. This is indicative of the fact that the second shingle 1006 can be replaced without damaging the first shingle 1004.

Additionally, another nail 1005 passing through the second shingle 1006 is exposed beyond an end 1007 of the base member 1008 located distally from the convex edge 1002 of the shingle testing tool 100. Accordingly, the first shingle 1004 is in good condition and can be sufficiently manipulated such that the second shingle 1006 can be replaced without affecting the structural integrity of the first shingle 1004.

At this point, an inspector can take a picture of the shingle testing tool 1000, the first shingle 1004, and the second shingle 1006 for subsequent review. After making this assessment and/or taking the photographs, the shingle testing tool 1000 can be withdrawn from between the first shingle 1004 and the second shingle 1006. Other shingles of this roof can then be tested in a similar fashion.

Figure 11:
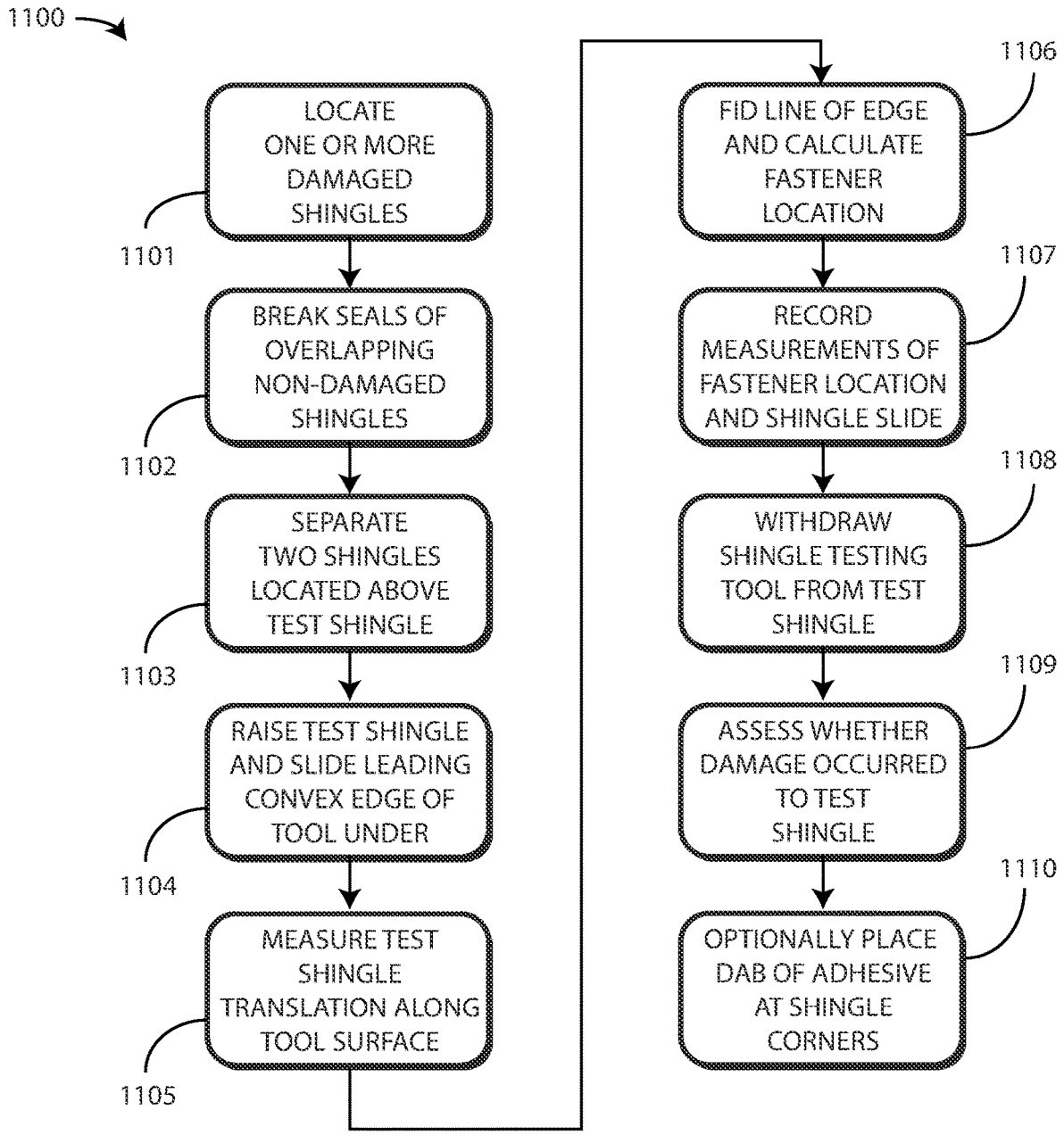
FIG. 11 illustrates another explanatory method of using a shingle tool in accordance with one or more embodiments of the disclosure.

Turning now to FIG. 11, illustrated therein is another method 1100 of using a shingle testing tool configured in accordance with one or more embodiments of the disclosure. Discussion of the method steps of FIG. 11 is made with reference to FIGS. 12-16 so that the operations occurring in each step may be more readily understood.

Figure 12:
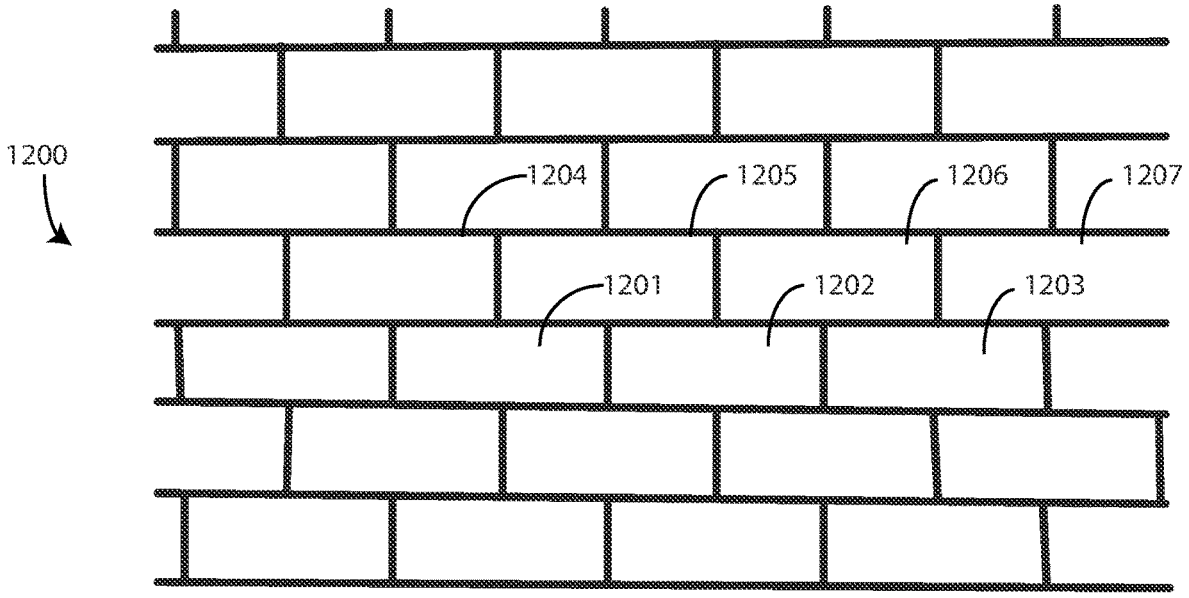
FIG. 12 illustrates a roof having one or more damaged shingles.

Beginning at step 1101, the method 1100 includes locating one or more damages shingles on a roof that may need replacing. Turning briefly to FIG. 12, illustrated therein is one explanatory roof 1200 that includes one or more damaged shingles 1201,1202,1203.

The roof 1200 of FIG. 12 is a typical, asphalt-shingled roof that includes shingles placed atop a structure, which is typically constructed from plywood or another wood product. As shown in FIG. 12, the shingles of such a roof 1200 are typically overlaid in a typical overlapping pattern. The shingles are typically nailed to the roof 1200, with each asphalt shingle slightly overlapping the one below it. This overlapping structure allows one shingle situated atop another to cover the nails securing the underlying shingle. In FIG. 12, shingles 1201,1202,1203 are damaged. However, shingles 1204,1205,1206,1207 are not damaged.

Figure 13:
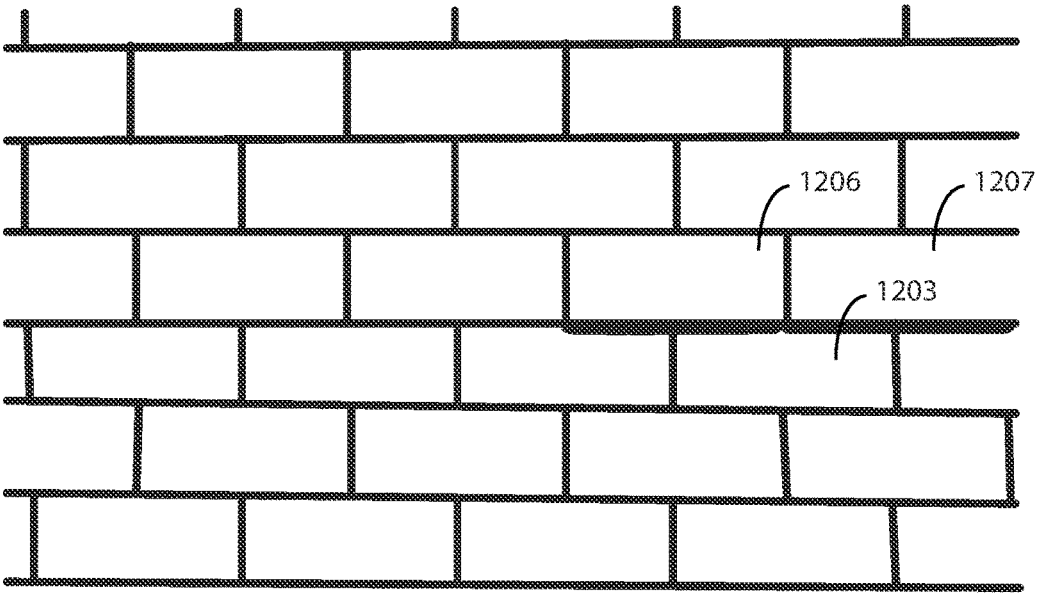
FIG. 13 illustrates the roof of FIG. 12 after one or more method steps from FIG. 11 have been performed.

Turning back to FIG. 11, at step 1102 the method 1100 includes breaking the seals of one or more non-damaged shingles, e.g., shingles (1204,1205,1206,1207) of FIG. 12, that are situated above one or more damaged shingles, e.g., shingles (1201,1202,1203) of FIG. 12. This allows for quick and easy inspection of the shingle without inducing damage or diminishing the remaining service life of the shingle during the inspection process. As shown in FIG. 13, the seal between shingle 1203 and shingles 1206,1207 has been broken. This allows shingle 1206 to be the "test" shingle.

Figure 14:
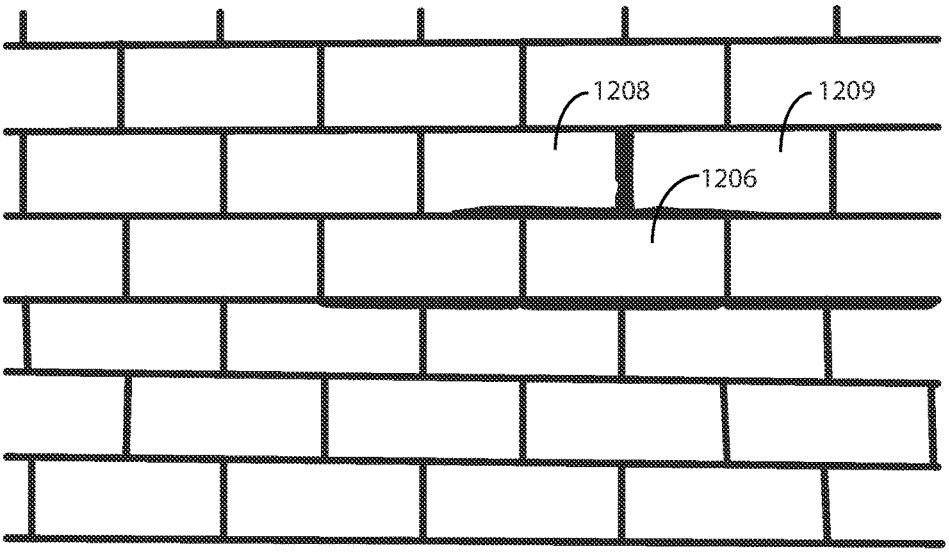
FIG. 14 illustrates the roof of FIG. 12 after one or more method steps from FIG. 11 have been performed.

Turning back to FIG. 11, at step 1103 the method 1100 comprises separating the two shingles located above the test shingle. This step 1103 eliminates unnecessary pressure at the top of the test shingle to allow the entire length of the test shingle to be lifted up to the point of where it is fastened. As shown in FIG. 14, shingle 1208 and shingle 1209 have been separated from shingle 1206, which is the test shingle in this example.

Figure 15:
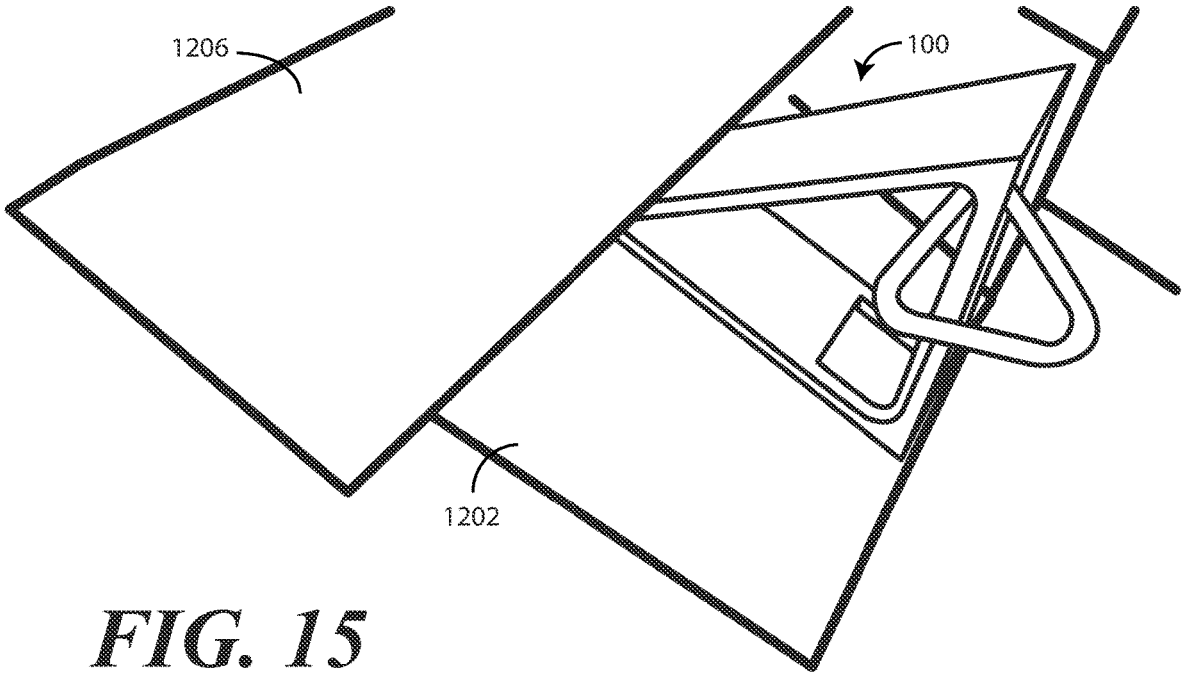
FIG. 15 illustrates one explanatory shingle testing tool configured in accordance with one or more embodiments of the disclosure in use.

Turning now back to FIG. 11, at step 1104 the method 1100 comprises raising the test shingle and sliding the leading convex edge of the shingle testing tool beneath the lower edge of the test shingle. The shingle testing tool is then translated to the fasteners passing through the test shingle, i.e., up the roof, until significant resistance can be felt and translation stops. Additional force applied thereafter can cause the fasteners to tear through the test shingle. This would, of course, damage the test shingle and require it to be replaced. As shown in FIG. 15, the leading convex edge (105) of one explanatory shingle testing tool 100 configured in accordance with one or more embodiments of the disclosure has been inserted between shingle 1206 and shingle 1202. This insertion would then continue until the shingle testing tool 100 could no longer be easily inserted between shingle 1206 and shingle 1202.

Figure 16:
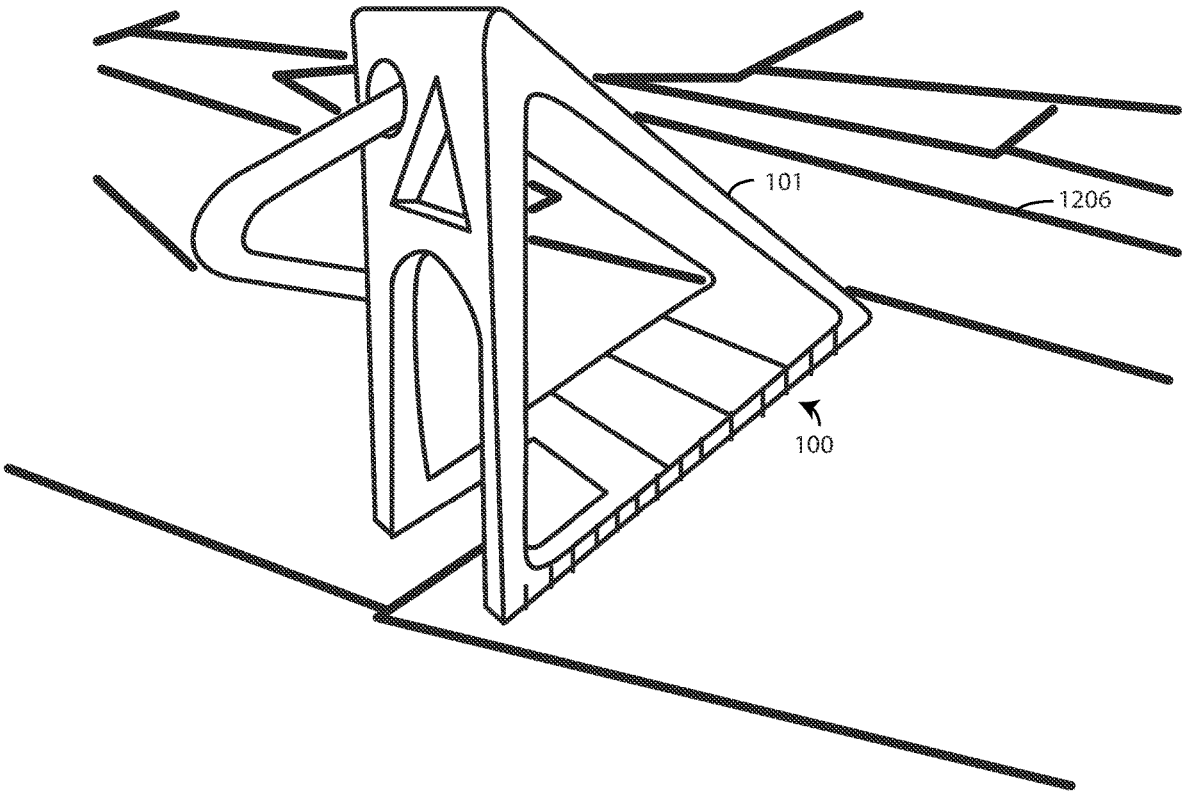
FIG. 16 illustrates one explanatory shingle testing tool configured in accordance with one or more embodiments of the disclosure in use.

Turning now back to FIG. 11, at step 1105 the method 1100 comprises measuring the amount the test shingle has translated along the inclined shingle support plate of the shingle testing tool, as this indicates an elevation of the shingle's edge. As previously described, due to the inclusion of the one or more first portion measurement indicators extending distally from the one or more shingle structural reliability measurement graduations situated on the inclined shingle support plate on a one-to-one basis, and optionally the major surface of the base member facing the inclined shingle support plate comprising a plurality of base member measurement indicators each arranged in a coplanar relationship with at least one first portion measurement indicator of the one or more first portion measurement indicators and one shingle structural reliability measurement indicator of the one or more shingle structural reliability measurement indicators, the same measurement will be reflected on the side panels and base as well. In one or more embodiments, the one or more first portion measurement indicators extending distally from the one or more shingle structural reliability measurement graduations situated on the inclined shingle support plate on a one-to-one basis protrude from the side panels, thereby making them easy to see. As shown in FIG. 16, in this illustrative example shingle 1206 extends to the full four inch measurement indicator, thereby indicating that the edge of the shingle has elevated four inches from the rooftop when the edge situates as shown on the inclined shingle support plate 101 of the shingle testing tool 100.

Turning now back to FIG. 11, at step 1106 the method 1100 comprises finding the line of the of the test shingle's edge and then calculating the distance from the shingle's edge to where a fastener of the damaged shingle should be placed.

Embodiments of the disclosure contemplate that it is important not use the fastener currently holding the damaged shingle in place as a measuring point due to the fact that many fasteners are installed incorrectly. Illustrating by example, experimental testing has shown that many times nails or other fasteners holding a shingle to a roof are positioned too high. Moreover, these nails or fasteners may be placed on or above the sealant strip of a shingle. Experimental testing has confirmed that the general target point for a particular fastener is approximately three-eights of an inch above the butt line of a shingle. (The "butt line" is usually defined by a change in the pattern and colors of the granules of a shingle, and is, in most cases, positioned below the sealant strip.)

In one or more embodiments, step 1106 comprises calculating the measurement of the shingle's edge to the fastener location using the second portion of the side panel extending from the first side of the base member and its plurality of second portion measurement indicators, which are recessed in one or more embodiments, and which define a ruler extending along the second portion of the first side panel from the first end of the base member to the second end of the base member. In one or more embodiments, these second portion measurement indicators are positioned in one quarter and one eighth inch increments along the side panel. In one or more embodiments the measurement of step 1106 can be performed when the shingle testing tool (100) is positioned as shown in FIG. 16.

At step 1107, the method 1100 comprises recording the measurements made at step 1106. Additionally, step 1107 can comprise photographing the shingle testing tool (100) as positioned in FIG. 16 so that the one or more first portion measurement indicators extending distally from the one or more shingle structural reliability measurement graduations on a one-to-one basis, the plurality of base member measurement indicators each arranged in a coplanar relationship with at least one first portion measurement indicator of the one or more first portion measurement indicators and one shingle structural reliability measurement indicator of the one or more shingle structural reliability measurement indicators, and the plurality of second portion measurement indicators can be seen. Recordation of such measurements and capture of such photographs allow the inspection occurring with the shingle testing tool (100) to be reviewed post-inspection. Additionally, recordation of such measurements and capture of such photographs illustrate the elevation of the test shingle, as well as how far the fastener placement is from the test shingle's edge.

At step 1108, the method 1100 comprises withdrawing the shingle testing tool from between the test shingle and the damaged shingle. In one or more embodiments, step 1108 results in the test shingle returning to its pre-test position. Thereafter, step 1109 comprises assessing the test shingle to ensure that no damage, examples of which include tearing or creasing, has occurred during the testing process.

Once step 1109 is complete, embodiments of the disclosure contemplate that the sealant strips that were disturbed between the test shingle and the damage shingle and/or the shingles above the test shingle may not reseal on their own. These phenomena can occur due to any of a number of reasons, examples of which include deteriorated sealant, cold sealant, or dirt and/or debris trapped on sealant. By contrast, the sealant bond may have been initially too strong to separate the test shingle from the damaged shingle without the significant transfer of material between shingles. In these scenarios, optional step 1110 comprises placement of a dab of roofing adhesive at the corners of the shingle tabs that were separated during the various steps of the method 1100 of FIG. 11. Where included, optional step 1110 ensures a tight bond between manipulated shingles while decisions are made regarding the best means of repair. Additionally, step 1110 helps to prevent the unsealed shingles from future wind events should it become a factor during the decision period and time of replacement or repair.

It should be noted that the method 1100 of FIG. 11 can be used with multiple shingle testing tools as well. Illustrating by example, when pliability tests are necessary for architectural/laminated shingles, the steps of the method 1100 can be performed with a first shingle testing tool positioned beneath one side of a test shingle and another shingle testing tool positioned beneath the opposite side of the test shingle. This additional support offered by the use of a second shingle testing tool can advantageously prevent the test shingle from tenting and possibly tearing. Where a second shingle testing tool is employed, testing has demonstrated that the second shingle testing tool should be spaced approximately one-third of the length of the test shingle. Laminated shingles are generally thirty-six to thirty-nine inches in length. Spacing shingles in this manner evenly distributes weight to prevent tenting or reverse tenting during the process.

In addition to testing for repair as described with reference to the method 1100 of FIG. 11, it should be noted that shingle testing tools configured in accordance with embodiments of the disclosure can also be used for post installation inspections to verify proper fastener placement. When used in this manner, the method of testing is the same as the method 1100 of FIG. 11. Additionally, shingle testing tools configured in accordance with embodiments of the disclosure can also be used to obtain the proper amount of shingle elevation and clearance needed for repair during shingle installation as well. Other advantageous uses of shingle testing tools configured in accordance with embodiments of the disclosure will be obvious to those of ordinary skill in the art having the benefit of this disclosure.

As noted above, shingle testing tools configured in accordance with embodiments of the disclosure can be manufactured from thermoplastic materials using an injection molding or other similar process. However, embodiments of the disclosure contemplate that shingle testing tools can be manufactured in other was as well. Illustrating by example, in other embodiments a shingle testing tool can be constructed from metal using a blank and a bending process.

Figure 17:
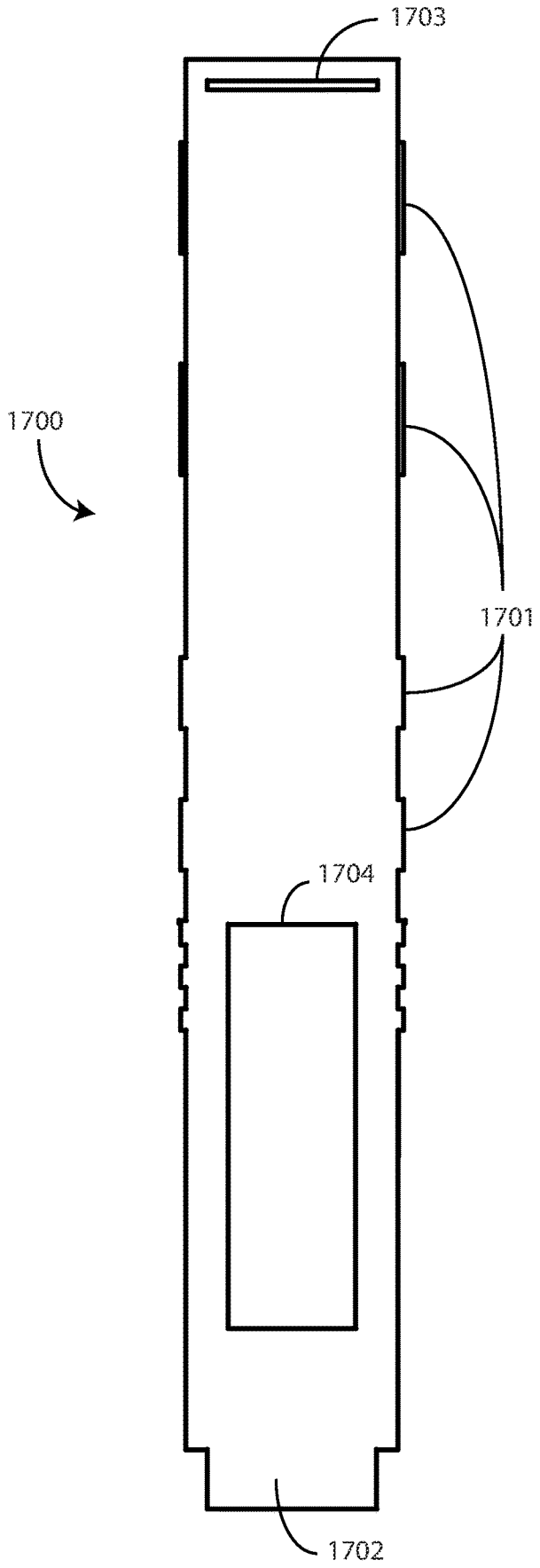
FIG. 17 illustrates one explanatory blank in accordance with one or more embodiments of the disclosure.

Turning now to FIG. 17, illustrated therein is a blank 1700 from which a shingle testing tool configured in accordance with embodiments of the disclosure can be manufactured. In one or more embodiments, the blank 1700 is cut from metal, one example of which is sixteen-gauge stainless steel. The blank 1700 can include one or more contours 1701 situated along the sides of the blank that can serve, for example, as the shingle structural reliability measurement graduations, first portion measurement indicators, second portion measurement indicators, or other measurement indicators. The blank 1700 can further include a tab 1702 and slot 1703. When the blank 1700 is folded into a shingle testing tool, one example of which is shown in FIG. 18, the tab 1702 can be inserted into the slot 1703 to retain the apparatus together.

Other features can be included in the blank 1700 as well. For instance, the blank 1700 of FIG. 17 includes an aperture 1704 that provides a function similar to the arched aperture (501) included in the shingle testing tool (100) of FIGS. 1-8 above. Other features suitable for inclusion in the blank 1700 will be obvious to those of ordinary skill in the art having the benefit of this disclosure.

Figure 18:
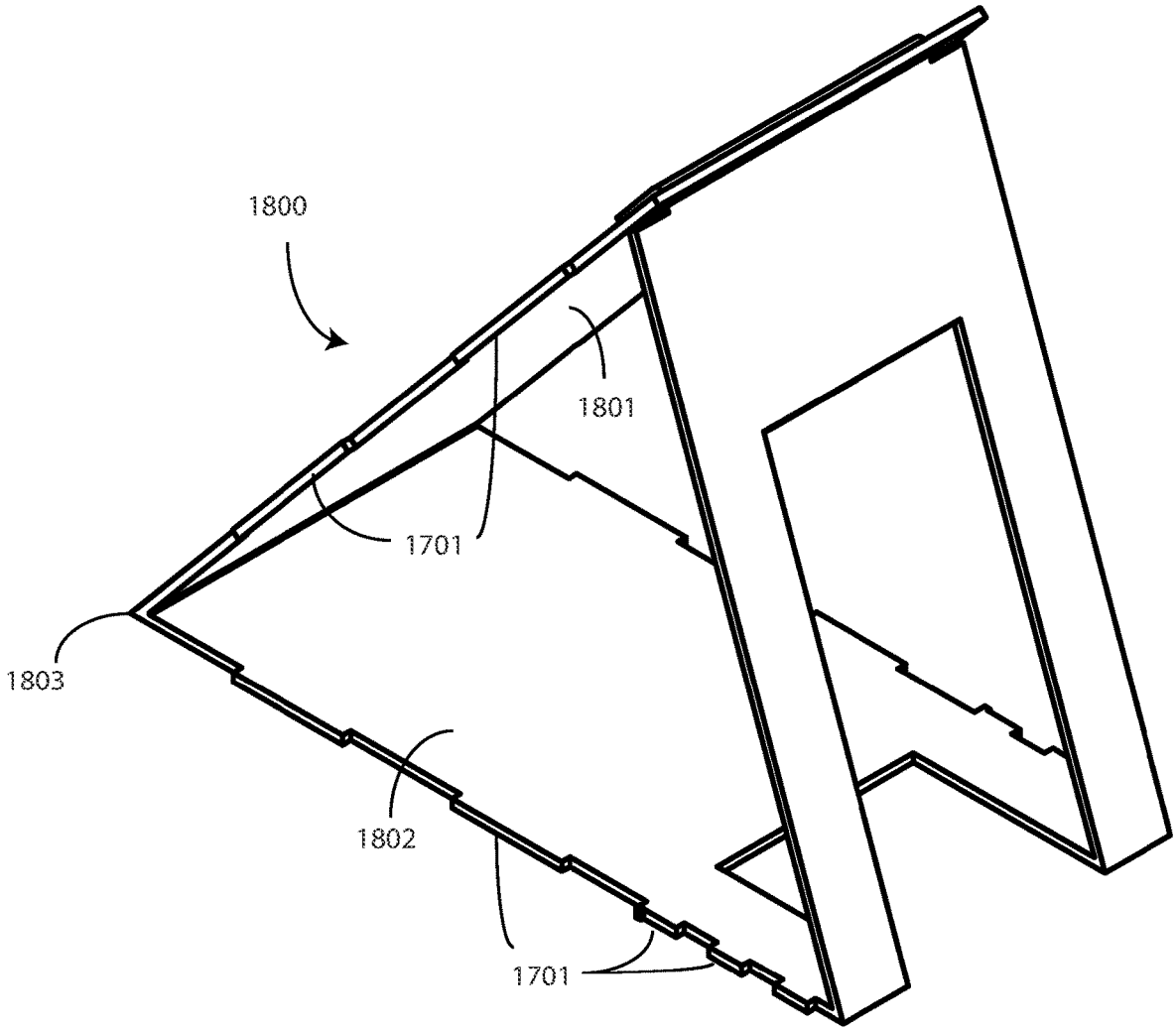
FIG. 18 illustrates another explanatory shingle testing tool in accordance with one or more embodiments of the disclosure.

Turning now to FIG. 18, illustrated therein is one explanatory shingle testing tool 1800 formed when the blank (1700) of FIG. 17 is bent in two places. As before, the shingle testing tool 1800 includes a base member 1802 and an inclined shingle support plate 1801. The inclined shingle support plate 1801 and the base member 1802 intersect at a first end of the base member 1802 at a leading convex edge

1803. The one or more contours 1701 define both the shingle structural reliability measurement graduations for the inclined shingle support plate 1801 and the second portion measurement indicators for the base member 1802. The shingle testing tool 1800 can be used in accordance with the methods of either FIG. 9 or FIG. 11 as previously described.

Figure 19:
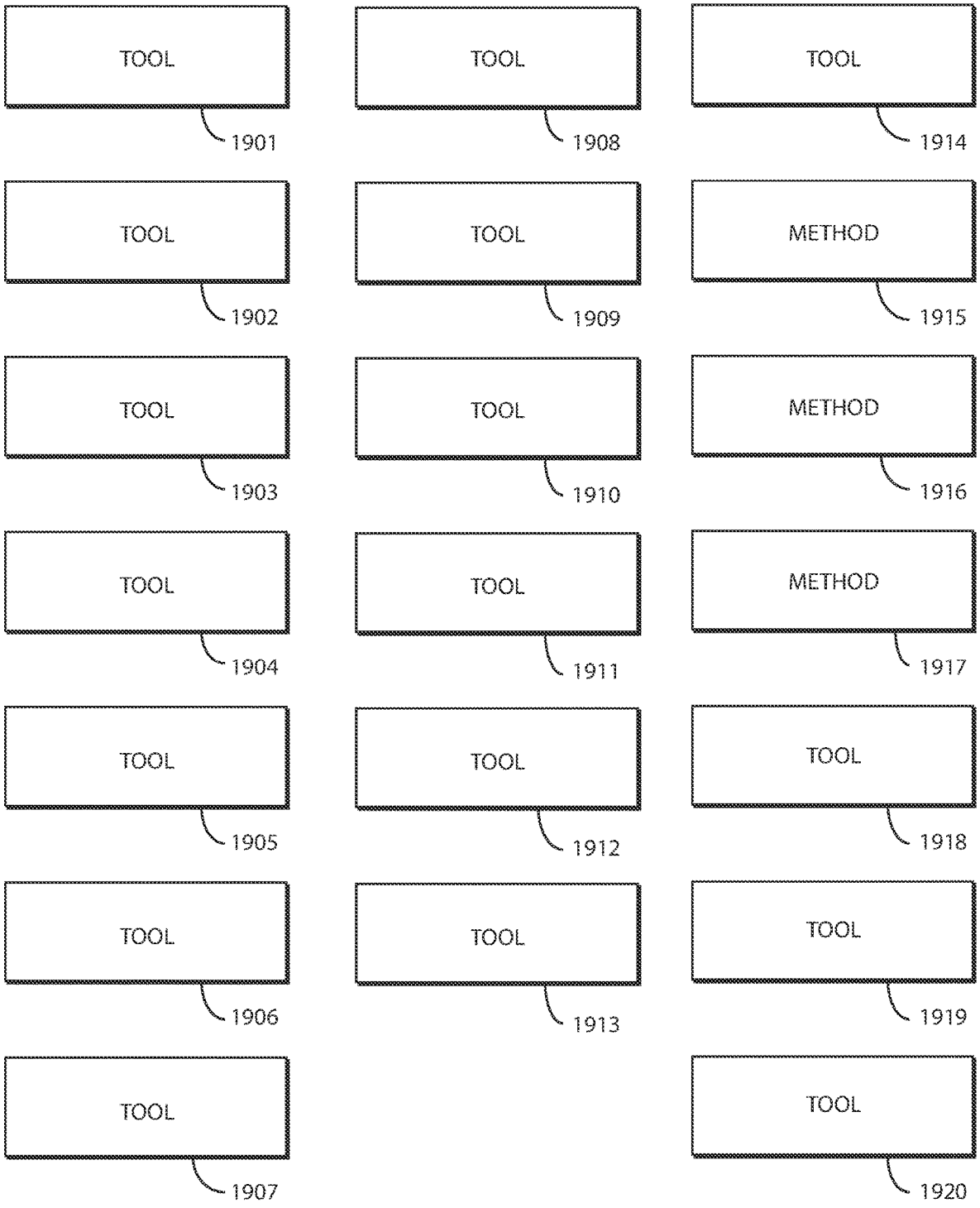
FIG. 19 illustrates various embodiments of the disclosure.

Turning now to FIG. 19, illustrated therein are various embodiments of the disclosure. The embodiments of FIG. 19 are shown as labeled boxes in FIG. 19 due to the fact that the individual components of these embodiments have been illustrated in detail in FIGS. 1-18, which precede FIG. 19. Accordingly, since these items have previously been illustrated and described, their repeated illustration is no longer essential for a proper understanding of these embodiments. Thus, the embodiments are shown as labeled boxes.

At 1901, a shingle testing tool comprises a base member and an inclined shingle support plate. At 1901, the base member intersects a first end of the base member at a leading convex edge. At 1901, the inclined shingle support plate defines one or more shingle structural reliability measurement graduations.

At 1902, the shingle testing tool of 1901 further comprises a rear support member. At 1902, the rear support member intersects a second end of the base member at a trailing convex edge. At 1902, the rear support member extends to a distal end of the inclined shingle support plate.

At 1903, the shingle testing tool of 1902 further comprises a first side panel spanning a first side of each of the base member, the inclined shingle support plate, and the rear support member. At 1904, the first side panel of 1903 defines an aperture having a central axis oriented substantially orthogonally with other axes passing normally through the each of the base member, the inclined shingle support plate, and the rear support member, respectively. At 1905, the aperture of 1904 is substantially triangular.

At 1906, a first portion of the first side panel of 1904 extending from the first side of the inclined shingle support plate defines one or more first portion measurement indicators extending distally from the one or more shingle structural reliability measurement graduations on a one-to-one basis. At 1907, the shingle testing tool of 1906 further comprises numerical indicia positioned adjacent to at least some measurement indicators of the one or more measurement indicators.

At 1908, a major surface of the base member of 1906 facing the inclined shingle support plate comprises a plurality of base member measurement indicators each arranged in a coplanar relationship with at least one first portion measurement indicator of the one or more first portion measurement indicators and one shingle structural reliability measurement indicator of the one or more shingle structural reliability measurement graduations. At 1909, a second portion of the first side panel extending from the first side of the base member comprises a plurality of second portion measurement indicators, with at least some second portion measurement indicators of the plurality of second portion measurement indicators being co-linear with the one or more first portion measurement indicators on a one-to-one basis.

At 1910, at least some other second portion measurement indicators of the plurality of second portion measurement indicators of 1909 define a ruler extending along the second portion of the first side panel from the first end of the base member to the second end of the base member.

At 1911, the rear support member of 1910 defines an arched aperture defining a convex contour extending toward the distal end of the inclined shingle support plate. At 1912, an apex of the convex contour of 1911 is situated closer to the distal end of the inclined shingle support plate than to the second end of the base member.

At 1913, the rear support member of 1910 defines a karabiner attachment port. At 1914, the base member of 1901 is coupled to the inclined shingle support plate by a first hinge and the rear support member is coupled to the base member by a second hinge.

At 1915, a method of using a shingle testing tool comprises inserting a convex edge of the shingle testing tool positioned between a base member and an inclined shingle support plate between a first shingle and a second shingle. At 1915, the method comprises translating the convex edge of the shingle testing tool toward a nail passing through the first shingle, thereby causing the first shingle to climb the inclined shingle support plate. At 1915, the method comprises measuring, using one or more shingle structural reliability measurement graduations, an amount the first shingle has climbed the inclined shingle support plate. In one or more embodiments, this measurement indicates an amount of elevation of the shingle's edge from the rooftop.

At 1916, the method of 1915 further comprises determining whether another nail passing through the second shingle is exposed beyond an end of the base member located distally from the convex edge. At 1917, the method of 1916 further comprises withdrawing the shingle testing tool from between the first shingle and the second shingle.

At 1918, a shingle testing tool comprises a base defining a substantially planar surface. At 1917, the shingle testing tool comprises an inclined shingle support plate intersecting the base to define a single wedge with a leading edge of between forty-five and fifty-five degrees, inclusive. At 1918, the inclined shingle support plate defines a plurality of measurement graduations indicating multiples of a predefined measurement unit from the leading edge.

At 1919, base member of 1918 is coupled to the inclined shingle support plate by a first hinge with a first spring applying a preloading force axially biasing the inclined shingle support plate toward the base member. At 1919 the rear support member is coupled to the base member by a second hinge with a second spring applying another preloading force axially biasing the rear support member toward the base member.

At 1920, the shingle testing tool of 1919 further comprises a first side panel spanning a first side of the base member and the inclined shingle support plate. At 1920, the shingle testing tool of 1919 comprises a second side panel spanning a second side of the base member and the inclined shingle support plate.

At 1920, Each of the first side panel and the second side panel define an aperture having a central axis oriented substantially orthogonally with other axes passing normally through the base member and the inclined shingle support plate, respectively. At 1920, each of the first side panel and the second side panel define four side panel measurement indicators extending distally from the four measurement graduations on a one-to-one basis.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims.

Figure 20:
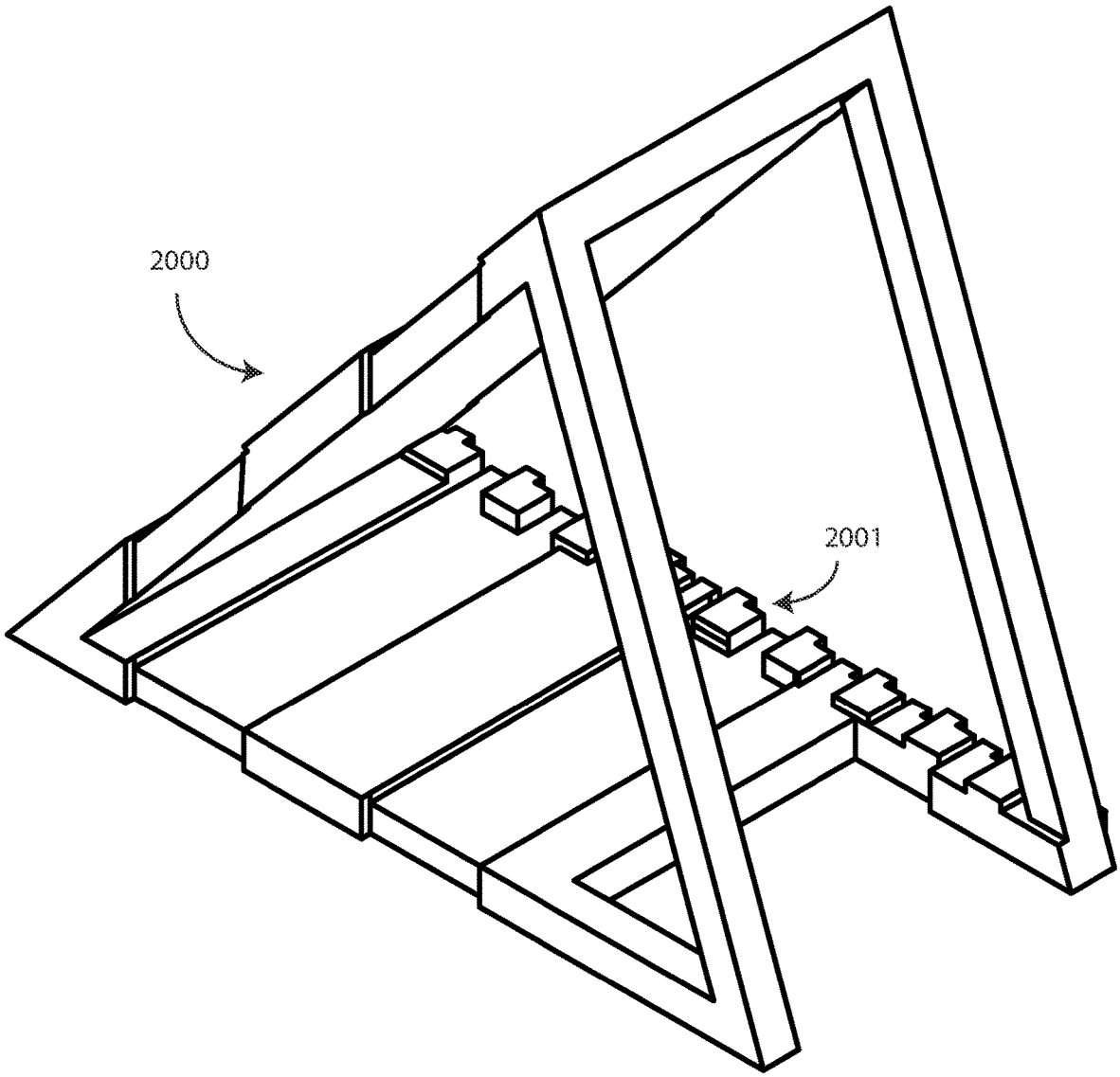
FIG. 20 illustrates still another explanatory shingle testing tool configured in accordance with one or more embodiments of the disclosure.

For example, while the shingle testing tool of FIGS. 1-8 included a first side panel and a second side panel that were similarly configured, e.g., with the one or more first portion measurement indicators and one or more second portion measurement indicators positioned on both the first side panel and the second side panel, in other embodiments only one side may include these measurement indicators. Turning to FIG. 20, illustrated therein is yet another explanatory shingle testing tool 2000. As shown in FIG. 20, in other embodiments the shingle testing tool 2000 may include the one or more second portion measurement indicators 2001 only on one side of the shingle testing tool 2000. Other variations to the shingle testing tool 2000 will be obvious to those of ordinary skill in the art having the benefit of this disclosure.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A shingle testing tool, comprising:

a base member; and an inclined shingle support plate intersecting a first end of the base member at a leading convex edge;

wherein the inclined shingle support plate defines one or more shingle structural reliability measurement graduations.

2. The shingle testing tool of claim 1, further comprising a rear support member intersecting a second end of the base member at a trailing convex edge and extending to a distal end of the inclined shingle support plate.

3. The shingle testing tool of claim 2, further comprising a first side panel spanning a first side of each of the base member, the inclined shingle support plate, and the rear support member.

4. The shingle testing tool of claim 3, the first side panel defining an aperture having a central axis oriented substantially orthogonally with other axes passing normally through the each of the base member, the inclined shingle support plate, and the rear support member, respectively.

5. The shingle testing tool of claim 4, wherein the aperture is substantially triangular.

6. The shingle testing tool of claim 4, wherein a first portion of the first side panel extending from the first side of the inclined shingle support plate defines one or more first portion measurement indicators extending distally from the one or more shingle structural reliability measurement graduations on a one-to-one basis.

7. The shingle testing tool of claim 6, further comprising numerical indicia positioned adjacent to at least some measurement indicators of the one or more first portion measurement indicators.

8. The shingle testing tool of claim 6, wherein a major surface of the base member facing the inclined shingle support plate comprises a plurality of base member measurement indicators each arranged in a coplanar relationship with at least one first portion measurement indicator of the one or more first portion measurement indicators and one shingle structural reliability measurement indicator of the one or more shingle structural reliability measurement graduations.

9. The shingle testing tool of claim 6, wherein a second portion of the first side panel extending from the first side of the base member comprises a plurality of second portion measurement indicators, with at least some second portion measurement indicators of the plurality of second portion measurement indicators being co-linear with the one or more first portion measurement indicators on a one-to-one basis.

10. The shingle testing tool of claim 9, wherein at least some other second portion measurement indicators of the plurality of second portion measurement indicators define a ruler extending along the second portion of the first side panel from the first end of the base member to the second end of the base member.

11. The shingle testing tool of claim 10, wherein the rear support member defines an arched aperture defining a convex contour extending toward the distal end of the inclined shingle support plate.

12. The shingle testing tool of claim 11, wherein an apex of the convex contour is situated closer to the distal end of the inclined shingle support plate than to the second end of the base member.

13. The shingle testing tool of claim 10, wherein the rear support member defines a karabiner attachment port.

14. The shingle testing tool of claim 1, wherein the base member is coupled to the inclined shingle support plate by a hinge.

15. A method of using a shingle testing tool, the method comprising:

inserting a convex edge of the shingle testing tool positioned between a base member and an inclined shingle support plate between a first shingle and a second shingle;

translating the convex edge of the shingle testing tool toward a nail passing through the first shingle, thereby causing the first shingle to climb the inclined shingle support plate; and measuring, using one or more shingle structural reliability measurement graduations, an amount the first shingle has climbed the inclined shingle support plate.

16. The method of claim 15, further comprising determining whether another nail passing through the second shingle is exposed beyond an end of the base member located distally from the convex edge.

17. The method of claim 16, further comprising withdrawing the shingle testing tool from between the first shingle and the second shingle.

18. A shingle testing tool, comprising:

a base defining a substantially planar surface; and an inclined shingle support plate intersecting the base to define a single wedge with a leading edge of between forty-five and fifty-five degrees inclusive;

wherein the inclined shingle support plate defines a plurality of measurement graduations indicating multiples of a predefined measurement unit from the leading edge.

19. The shingle testing tool of claim 18, wherein the base is coupled to the inclined shingle support plate by a hinge with a first spring coupled to the hinge and applying a preloading force axially biasing the inclined shingle support plate toward the base.

20. The shingle testing tool of claim 19, further comprising:

a first side panel spanning a first side of the base and the inclined shingle support plate; and a second side panel spanning a second side of the base and the inclined shingle support plate;

wherein each of the first side panel and the second side panel define:

an aperture having a central axis oriented substantially orthogonally with other axes passing normally through the base and the inclined shingle support plate, respectively; and four side panel measurement indicators extending distally from measurement graduations of the plurality of measurement graduations on a one-to-one basis.

* * * * *